US006147584A

United States Patent [19]

Shin'el

[11] Patent Number: 6,147,584

[45] Date of Patent: Nov. 14, 2000

[54] INDUCTOR, TRANSFORMER, AND MANUFACTURING METHOD THEREOF

[75] Inventor: Ryu Shin'el, Yokohama, Japan

[73] Assignee: Ricoh Company, Ltd., Tokyo, Japan

[21] Appl. No.: 09/268,529

[22] Filed: Mar. 12, 1999

Related U.S. Application Data

[62] Division of application No. 08/405,176, Mar. 16, 1995, Pat. No. 5,939,966.

[30] Foreign Application Priority Data

Jun. 2, 1994 [JP] Japan ..... 6-121389

[51] Int. Cl.[7] ..... H01F 5/00; H01F 27/28

[52] U.S. Cl. ..... 336/223; 336/223; 336/232

[58] Field of Search ..... 336/200, 223, 336/232, 83

[56] References Cited

U.S. PATENT DOCUMENTS

| | | |
|---|---|---|
| 2,568,169 | 9/1951 | Raczynski . |
| 2,816,273 | 12/1957 | Peck . |
| 3,200,948 | 8/1965 | Farrend . |
| 3,351,879 | 11/1967 | Kaufman . |
| 3,466,586 | 9/1969 | Bull et al. . |
| 3,697,911 | 10/1972 | Strauss, Jr. . |
| 3,732,513 | 5/1973 | Farrand . |
| 3,772,587 | 11/1973 | Farrand et al. . |
| 3,947,934 | 4/1976 | Olson . |
| 4,223,360 | 9/1980 | Sansom et al. . |
| 4,942,373 | 7/1990 | Ozawa et al. . |
| 4,949,057 | 8/1990 | Ishizaka et al. . |
| 4,975,671 | 12/1990 | Dirks . |
| 5,030,931 | 7/1991 | Brooks et al. . |
| 5,087,896 | 2/1992 | Wen et al. . |
| 5,325,072 | 6/1994 | Kohiro et al. . |
| 5,372,967 | 12/1994 | Sundaram et al. . |
| 5,392,019 | 2/1995 | Ohkubo . |
| 5,414,356 | 5/1995 | Yoshimura et al. . |
| 5,425,167 | 6/1995 | Shiga et al. . |
| 5,450,755 | 9/1995 | Saito et al. . |
| 5,463,365 | 10/1995 | Iwatani et al. . |
| 5,495,213 | 2/1996 | Ikeda . |
| 5,524,490 | 6/1996 | Lautzenhiser et al. . |

FOREIGN PATENT DOCUMENTS

| | | |
|---|---|---|
| 4274305 | 1/1991 | Japan . |
| 5101939 | 8/1991 | Japan . |
| 4-92605 | of 1992 | Japan . |
| 5243057 | 9/1993 | Japan . |

*Primary Examiner*—Michael L. Gellner
*Assistant Examiner*—Anh Mai
*Attorney, Agent, or Firm*—Cooper & Dunham LLP

[57] ABSTRACT

An electric coil is formed of alternate strip parts and remaining strip parts. The alternate strip parts comprise alternate ones among a row of strip parts formed from a sheet of electrical conductor material, the row of strip parts forming a continuous electrical conductor having a form of a series of alternating reverse directional bends, a middle part of each strip part of the alternate strip parts being aligned with one another in a first line. The remaining strip parts comprise remaining ones among the row of strip parts, a middle part of each part of the remaining strip parts being aligned with one another in a second line separated from the first line. In manufacturing the electric coil, a forming member is used. The forming member has comb teeth, the comb teeth of the forming member being used to press and thus separate the middle part of each strip part of the alternate strip parts from the middle part of each strip part of the remaining strip parts.

8 Claims, 22 Drawing Sheets

INDUCTOR, TRANSFORMER, AND MANUFACTURING METHOD THEREOF

This is a divisional of application Ser. No. 08/405,176 filed Mar. 16, 1995, U.S. Pat. No. 5,939,966.

BACKGROUND OF THE INVENTION

1. Field of the Invention

The present invention relates to either a transformer such as a miniature power source transformer, or an inductor (an electric coil, an inductance coil or an inductor being simply referred to as an inductor, hereinafter) such as an inductor for a miniature motor, and in particular, to a high frequency inductor or transformer with each electric coils having a small winding turn number. Further, the present invention relates to an inductor, a transformer or the like used in a switching power source used in various machines, (including business machines such as electronic duplicators, facsimile machines, persona computers) household electric machines, and industrial machines (including electric automobile). In particular, the present invention relates to an inductor, a transformer or the like used in a DC/DC power source unit which is used for stepping up or stepping down a voltage which has been obtained as a result of rectifying a power frequency voltage. Furthermore, the present invention relates to a transformer or the like used in a control circuit for controlling the rotation of a motor, and to a inductor or the like used in a filter circuit for reducing noises.

2. Description of the Related Art

Conventionally, an inductor or transformer is manufactured as a result of winding an electrical wire on a bobbin through a wire winding machine. An EI core, a CI core or a barrel-type core is inserted into the bobbin having the electrical wire wound thereon.

In such a conventional inductor or transformer manufacturing process, steps of setting the bobbin on the wire winding machine, winding the electrical wire on the bobbin, and inserting the core into the bobbin require manpower. As a result, manufacturing efficiency is not high and manufacturing cost is high.

SUMMARY OF THE INVENTION

An object of the present invention is to provide an inductor and a transformer which can be manufactured in a very easy process and automatically manufactured in a mass production manner. Both the inductor and the transformer have a structure such that a winding turn number thereof is adaptable on demand. Another object of the present invention is to provide a manufacturing method for manufacturing such an inductor or transformer.

In order to achieve the above-mentioned object, an electric coil is provided, the electric coil comprising:

alternate strip parts comprising every other strip part in the row of strip parts formed from a sheet of electrical conductor material, the row of strip parts forming a continuous electrical conductor having a form of a series of alternating reverse directional bends, a middle part of each strip part of the alternate strip parts being aligned with one another in a first line; and remaining strip parts comprising, the remaining strip parts of the row of strip parts not included in the alternate strip parts subset, a middle part of each strip part of the remaining strip parts being aligned with one another in a second line separated from the first line.

A method for manufacturing the electric coil having the above-described structure comprises steps of:

a) processing a sheet of electrical conductor material to form a continuous electrical conductor having series of alternating reverse directional bends, the continuous electrical conductor thus comprising a row of strip parts; and b) moving a middle parts of each strip part of alternate strip parts among the row of strip parts so as to cause the middle part of each alternate strip part to be separate from a middle part of each strip part of remaining strip parts among the row of strip parts.

Thus, the electric coil can be easily formed.

In order to separate the middle parts of each strip part of the alternate strip parts from the middle parts of each strip part of the remaining strip parts, a forming member is used. The forming member has comb teeth, the comb teeth of the forming member being used to press and thus separate the middle part of each strip part of the alternate strip parts from the middle part of each strip part of the remaining strip parts.

The thus-used forming member may be either used as a bobbin of the coil or used as a jig and thus removed from the coil.

Further, in a case where an electric coil is mounted on a substrate and thus a circuit device is formed:

the middle part of each strip part of the alternate strip parts is separated from a surface of the substrate; and remaining strip parts comprise the remaining strip parts of the row of strip parts not included in the alternate strip parts subset, a middle part of each strip part of the remaining strip parts being bonded onto the surface of the substrate.

When the coil is formed, the middle parts of each strip part of the remaining strip parts are bonded onto the surface of the substrate and also through holes are formed in the substrate. Then, the middle parts of each strip part of the alternate strip parts are pressed via the through holes. Thus, the middle parts of each strip part of the alternate strip can be easily separated from the middle parts of each strip part of the remaining strip parts. Further, by this method, the mounting of the electric coil onto the substrate can be performed at the same time the coil is formed. In other words, the coil forming work and the coil mounting work are performed in a single process.

It is possible to form a folded patterned wiring pattern member instead of the above-described folded patterned electrical conductor. In a case where the folded patterned electrical conductor is used, a turn of a coil is formed from a pair of adjacent strip parts. In a case where the folded patterned wiring pattern member is used, it is possible to form a plurality of turns of a coil from a pair of strip parts. This is because, in the folded patterned wiring pattern member, each strip part contains a plurality of lines of an electrical conductor as a form of a wiring pattern formed in the strip part.

As a result, it is possible to effectively increase a number of winding turns without increasing a number of times the folded pattern is folded back.

Other objects and further features of the present invention will become more apparent from the following detailed description when read in conjunction with the accompanying drawings.

DESCRIPTION OF PREFERRED EMBODIMENTS

With regard to FIGS. 1 through 4, a transformer and a transformer manufacturing method in a first embodiment of the present invention will now be described.

Figure 1:
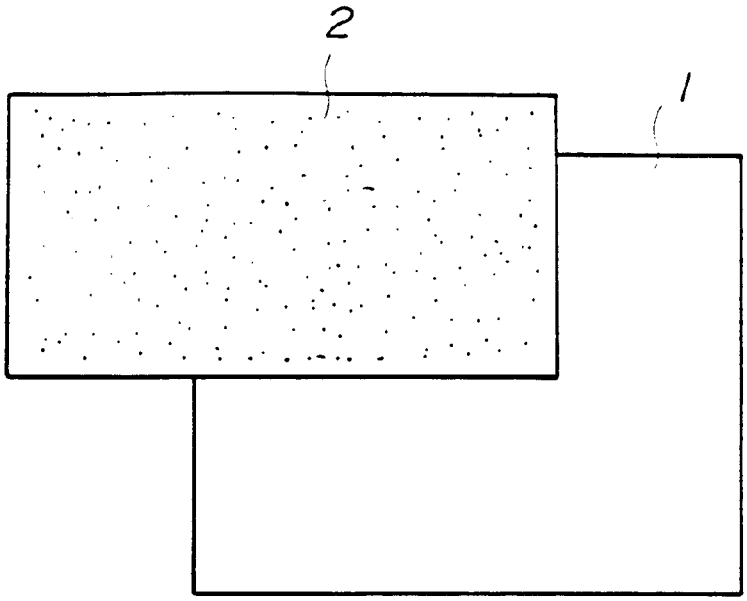
FIG. 1 shows a plan view of insulated electrically conductive foils laid on each other used in a first embodiment of the present invention.
Figure 2:
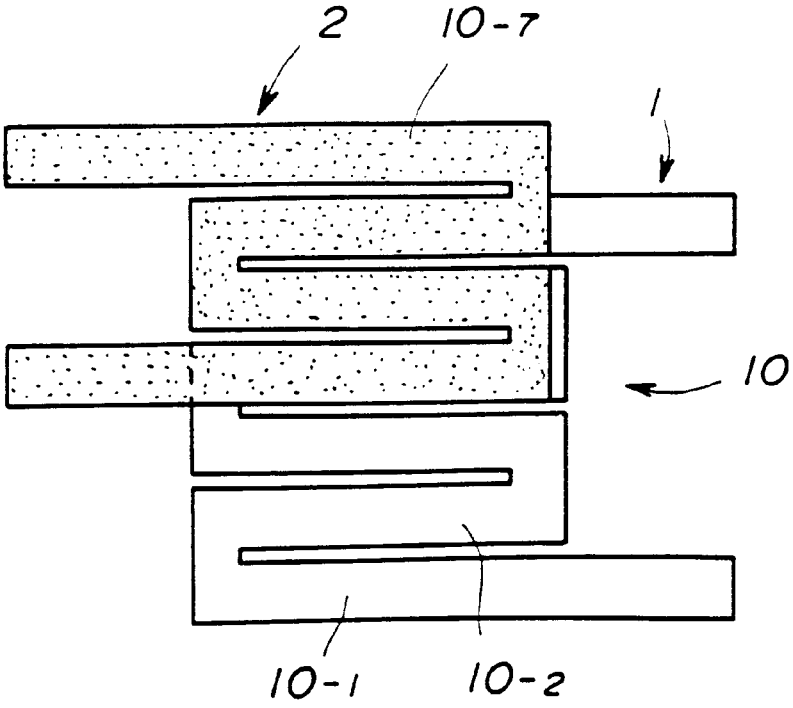
FIG. 2 shows a folded patterned foil member made from the foils shown in FIG. 1.

As shown in FIG. 1, two electrical conductor foils 1 and 2 are bonded together so that a part of a bottom surface of the foil 2 comes into contact with a part of a top surface of the foil 1. The thus-bonded foils will be referred to as a stack foil, hereinafter. Before the bonding, the entire surfaces of both of the foils 1 and 2 are electrically insulated. The stack foil is processed in a pressing processing manner so that a patterned foil member 10, shown in FIG. 2, is formed from the stack foil. As shown in the figure, the patterned foil member 10 has a shape as if it was formed as a result of folding straightly extending strip parts-many times. As shown in FIG. 2, the electrical conductor foil 1 of the foil member 10 has a shape as if it was formed as a result of folding back a strip part 5 times, and the electrical conductor foil 2 of the foil member 10 has a shape as if it was formed as a result of folding back a strip part 3 times. Such a patterned foil member is referred to as a folded patterned foil member and a shape such as that of the folded patterned foil member is referred to as a folded pattern, in the specification of the present application. With reference to FIG. 2, the folded patterned foil member 10 includes 7 straightly extending strip parts arranged in parallel starting from a strip part $\mathbf{10}_{-1}$ and ending at a strip part $\mathbf{10}_{-7}$.

Figure 3:
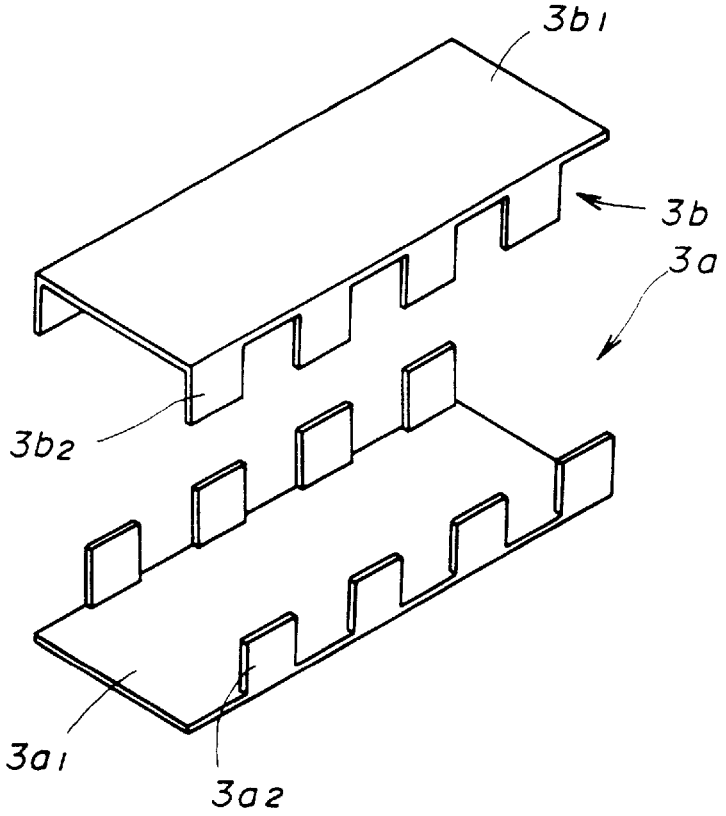
FIG. 3 shows a perspective view of forming members serving as a bobbin used in the first embodiment.

In addition to the folded patterned foil member 10, a pair of forming members 3*a* and 3*b* shown in FIG. 3 are also used for manufacturing the transformer in the first embodiment of the present invention. As shown in the figure, each of the pair of forming members 3*a* and 3*b* has a shape like an angular cornered letter "C". The forming members 3*a*, 3*b* have 8 comb teeth $\mathbf{3}a_2$, $\mathbf{3}b_2$ at two sides of rectangular bodies $\mathbf{3}a_1$, $\mathbf{3}b_2$, respectively, the teeth extending perpendicular to the bodies. As described later, the shape of comb teeth $\mathbf{3}a_2$ and $\mathbf{3}b_2$ matches the arrangement of the above-mentioned 7 strip parts of the folded patterned foil member 10. Further, the pair of forming members 3*a* and 3*b* are formed such that when the pair of members 3*a* and 3*b* appropriately come into contact with each other, a tooth of one member of the pair of members 3*a* and 3*b* is fitted into a space between two adjacent teeth of the other member of the pair of members 3*a* and 3*b*.

Each member of the pair of members 3*a* and 3*b* is made from an insulating material such as plastic in this embodiment and acts as a bobbin of coils of the transformer.

Figure 4:
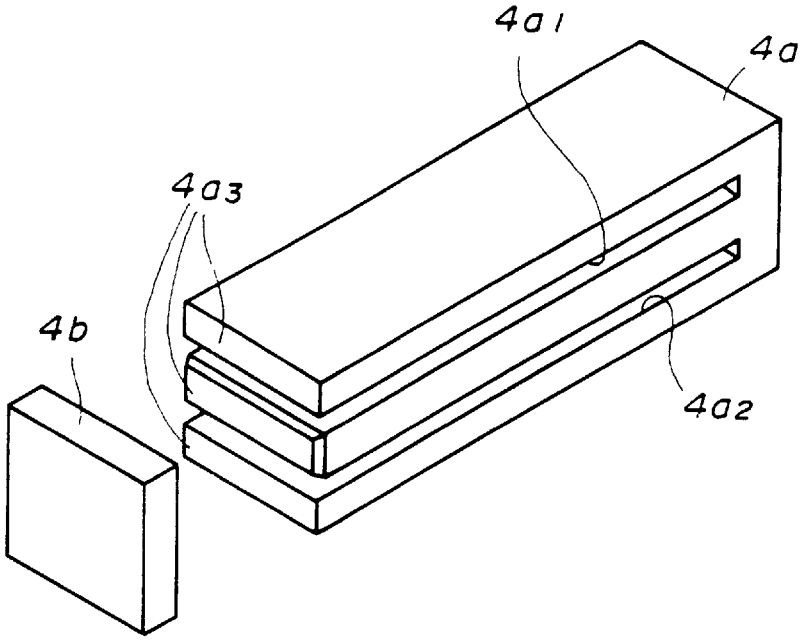
FIG. 4 shows a perspective view of an EI core used in the first embodiment.

Further, an EI core made from ferrite, shown in FIG. 4, is also used for manufacturing the transformer. As shown in FIG. 4, the EI core consists of a body 4*a* having a shape like the letter "E" as seen in a longitudinal sectional view thereof, and an end plate 4*b* having a shape like the letter "I" as seen in a sectional view thereof.

The above-described EI core (4*a* and 4*b*), and cores used in other embodiments of the present invention can be various types of cores such as, for example, an air-cored core, a magnetic core, or a dielectric core.

Figure 5:
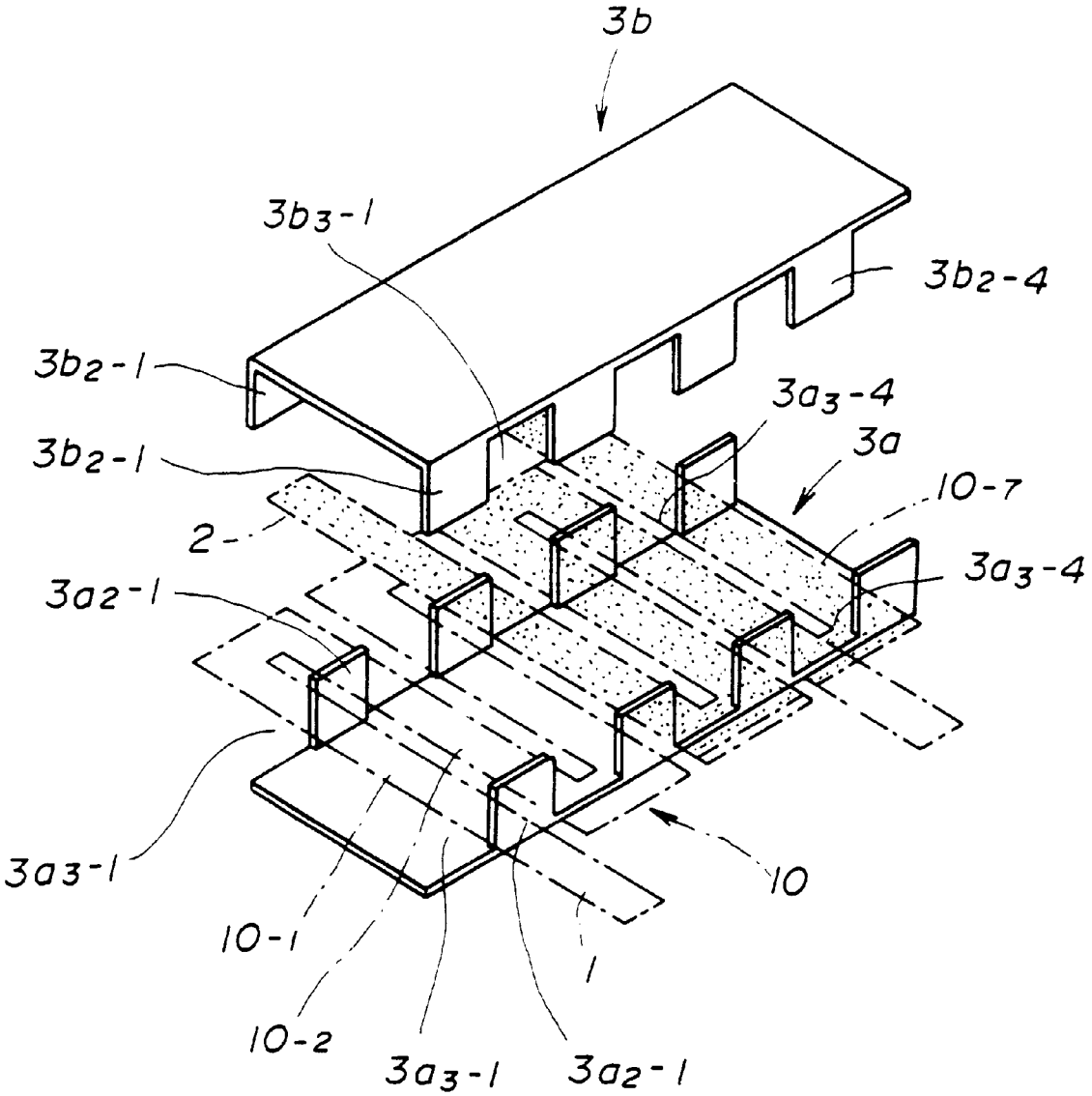
FIG. 5 shows a perspective view of a state in which the folded patterned foil member is sandwiched by the forming members in the first embodiment.

Then, as shown in FIG. 5, the folded patterned foil member 10 is placed on the forming member 3*a*. Thus, the strip part $\mathbf{10}_{-2}$ of the folded patterned foil member 10 is placed on a left front pair of opposite teeth $\mathbf{3}a_{2-1}$ of the 8 teeth $\mathbf{3}a_2$. The end strip part $\mathbf{10}_{-1}$, is placed on a pair of opposite spaces $\mathbf{3}a_{3-1}$, each of which spaces is located adjacent to a respective tooth of the left front pair of opposite teeth $\mathbf{3}a_{2-1}$. The strip part $\mathbf{10}_{-7}$ of the folded patterned foil member 10 is placed on a pair of opposite spaces $\mathbf{3}a_{3-4}$, each of which spaces is located between a right rear pair of opposite teeth and a pair of opposite teeth located adjacent to the right rear pair of opposite teeth of the 8 teeth $\mathbf{3}a_2$. Similarly, each of the other 4 strip parts of the folded patterned foil member 10 is placed either on a respective one pair of the remaining two pairs of opposite teeth or, alternately, on a respective one pair of the top remaining two pairs of opposite spaces.

Then, the forming member 3*b* is pressed to the bottom forming member 3*a* on which the folded patterned foil member 10 was placed as mentioned above. Thus, the top forming member 3*b* and the bottom forming member 3*a* together sandwich the folded patterned foil member 10. Thus, each tooth of a left front pair of opposite teeth $\mathbf{3}b_{211}$ of the top forming member 3*b* is fitted, via the left front strip part $\mathbf{10}_{-1}$, into a respective one of the pair of opposite spaces $\mathbf{3}a_{3-1}$ of the bottom forming member 3*a*. Each tooth of the left front pair of opposite teeth $\mathbf{3}a_{2-1}$ of the bottom forming member 3*a* is fitted, via the subsequent strip part $\mathbf{10}_{-2}$, into a respective one of the subsequent pair of spaces $\mathbf{3}b_{3-1}$ of the top forming member 3*b*. Each tooth of the right rear pair of opposite teeth $\mathbf{3}b_{2-4}$ of the top forming member 3*b* is fitted, via the right rear strip part $\mathbf{10}_{-7}$, into a respective one of the pair of spaces $\mathbf{3}a_{3-4}$ of the bottom forming member 3*a*. Similarly, each pair of the remaining intermediate 4 pairs of teeth of the forming members 3*a* and 3*b* is fitted into a respective one of the remaining intermediate 4 pairs of spaces of the forming members 3*a* and 3*b* via the remaining 4 strip parts of the folded patterned foil member 10.

Figure 6:
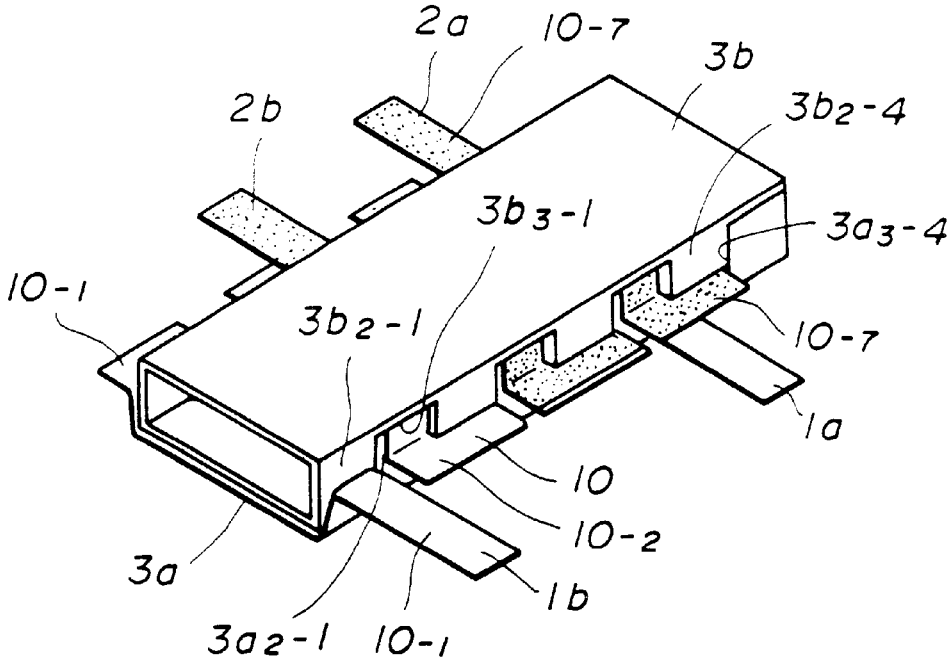
FIG. 6 shows a perspective view of a state in which coils have been formed from the folded patterned foil member using the forming members in the first embodiment.
Figure 7:
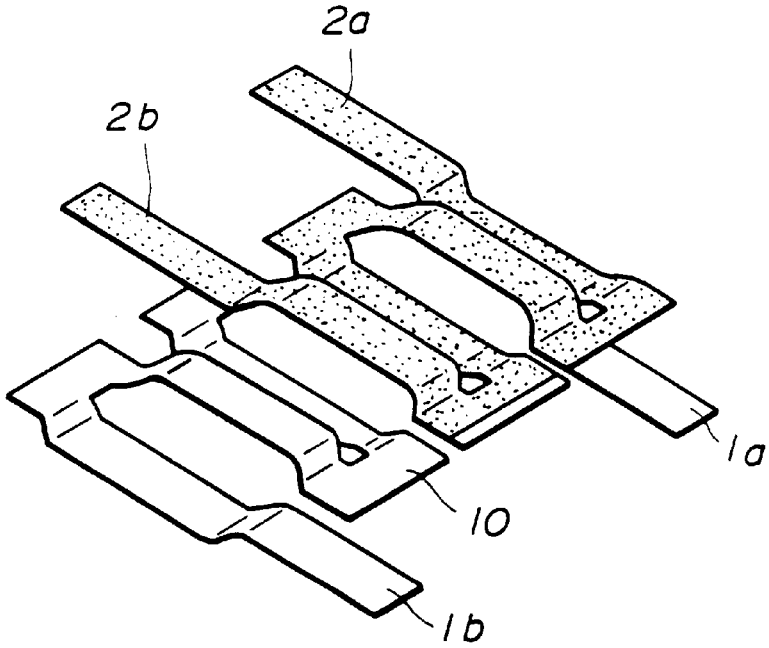
FIG. 7 shows a perspective view of the coils formed from the folded patterned foil member in the first embodiment.

Thus, the top forming member 3*b* is pressed to the bottom forming member 3*a* until the extending edge of each tooth $\mathbf{3}b_2$ of the top member 3*b* comes into contact with the body $\mathbf{3}a_1$ of the bottom member 3*a* and the extending edge of each tooth $\mathbf{3}a_2$ of the bottom member 3*a* comes into contact with the body $\mathbf{3}b_1$ of the top member 3*b*. The folded patterned foil member 10 is deformed as a result of being pressed between the top and bottom forming members 3*a* and 3*b*. Thus, each of the 7 strip parts of the folded patterned foil member 10 is displaced by the extending edge of a respective one of the teeth $\mathbf{3}a_2$ and $\mathbf{3}b_2$ either upward or downward alternating between adjacent strip parts. Then, after that, projecting portions of the folded patterned foil member 10 are folded as shown in FIG. 6. As a result of the forming members 3*a* and 3*b* sandwiching and pressing the folded patterned foil member 10 therebetween as the teeth of the upper member 3*a* are engaged with those of the lower member 3*b*, the folded patterned foil member 10 is formed into a shape shown in FIG. 7. Thus, the folded patterned foil member 10 is formed into coils in a coil bobbin assembly formed from the forming members 3*a* and 3*b*. The thus-formed coils consist of a first coil consisting of the electrical conductor foil 1 having 3 turns, and a second coil consisting of the electrical conductor foil 2 of the foil member 10 having 2 turns, as shown in FIG. 7.

In the above-mentioned coil bobbin assembly shown in FIG. 6, the forming members 3*a* and 3*b* together act as the bobbin for the coil. Then, the coil bobbin assembly is integrated with the EI core 4*a* and 4*b* shown in FIG. 4. Thus, the body $\mathbf{3}b_1$ of the top forming member 3*b* is inserted in an upper gap $\mathbf{4}a_1$ of the body 4*a* of the EI core 4*a* and 4*b*. Similarly, the body $\mathbf{3}a_1$ of the bottom forming member 3*a* is inserted in a lower gap $\mathbf{4}a_2$ of a main body 4*a* of the EI core 4*a* and 4*b*. Then, the EI core 4*a* and 4*b* is fixed to the coil bobbin assembly 10, 3*a* and 3*b* using clamping metal fittings (not show in the figures), and the end plate 4*b* of the EI core 4*a* and 4*b* is mounted onto the front left end surface $\mathbf{4}a_3$ of the body 4*a* of the EI core 4*a* and 4*b*. Thus, the transformer in the first embodiment of the present invention is formed. In the transformer, lead parts 2*a* and 2*b* of the second coil 2 having the smaller number of turns are used as primary input terminals and lead parts 1*a* and 1*b* of the first coil 1 having the larger number of turns are used as secondary input terminals. Thus, the transformer can be used as a step up transformer.

The present invention is not limited to the above-described two winding transformer in the first embodiment that is formed from the two layers of the insulated electrically conductive foils 1 and 2 resulting in the foil member 10 shown in FIG. 2, in which the number of times of folding back in the foil 1 of the foil member 10 (5 times, as mentioned above) is different from the number of times of folding back in the foil 2 of the foil member 10 (3 times, as mentioned above). The present invention encompasses a transformer formed from a plurality of layers, other than two layers, of insulated electrically conductive foil members and method of manufacturing such transformer. For example, a three winding transformer is formed from three layers of insulated electrically conductive foil members, in which the numbers of times of folding back in the foil members are different from one another. Further, an inductor is formed from a single layer of insulated electrically conductive foil member, in which the foil is processed to be a shape as if a straightly extending strip part is folded back a certain number of times.

Figure 8:
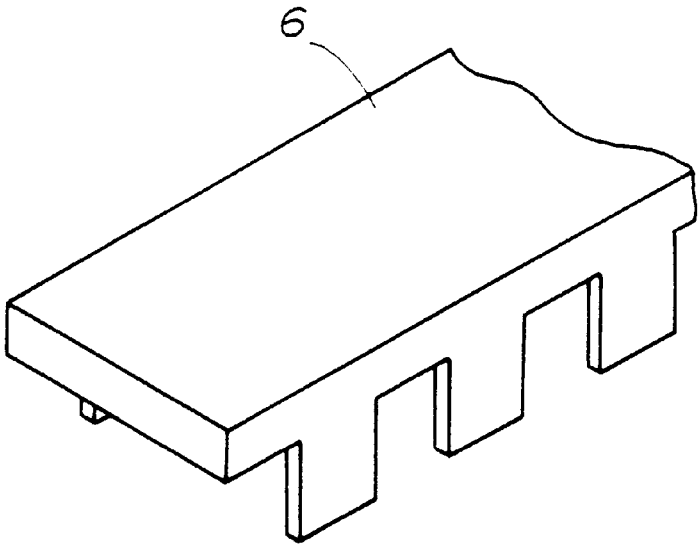
FIG. 8 shows a perspective view of a forming member made of ferrite used in a second embodiment of the present invention.
Figure 9:
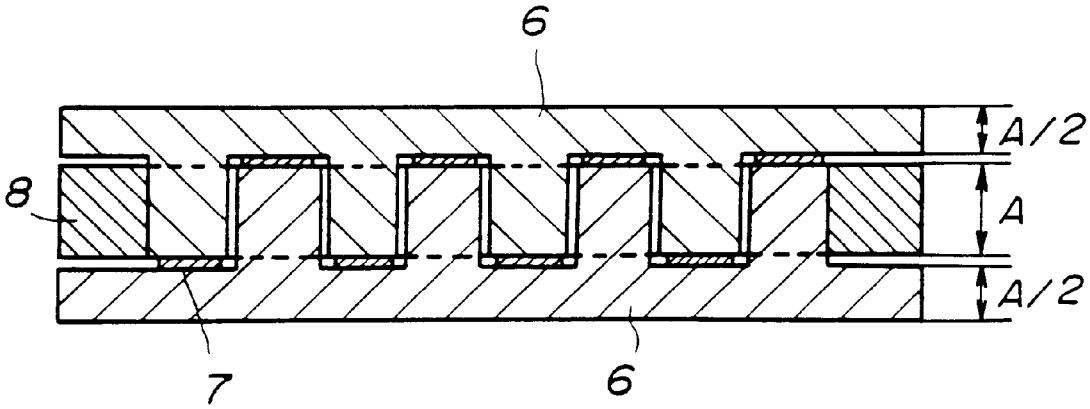
FIG. 9 shows a longitudinal sectional view of an assembly of either a transformer or an inductor in the second embodiment.

Further, the present invention is not limited to a transformer in which insulating material such as plastic is used to make the forming members such as the forming members 3*a* and 3*b* shown in FIG. 3 that are used as a bobbin. Magnetic materials such as ferrite may be also used to manufacturer the forming members. The transformer or inductor of the second embodiment of the present invention uses ferrite forming members. With reference to FIGS. 8 and 9, the transformer or inductor and manufacturing method in the second embodiment of the present invention will now be described. The transformer or inductor uses a pair of ferrite forming members 6, one of which is shown in FIG. 8. In addition to the pair of forming members 6, the transformer or inductor in the second embodiment uses a folded patterned foil member 7 such as, for example, the folded patterned foil member 10 shown in FIG. 2. Then, similarly to the above-described coil bobbin assembly forming process of the transformer in the first embodiment, the pair of forming members 6 together sandwich and press the folded patterned foil member 7 therebetween as teeth of one member are engaged with those of the other member. Thus, a coil is formed from the folded patterned foil member 7. Then, an I-type core 8 is inserted between the thus assembled pair of forming members 6 and thus into the thus-formed coil 7. In the transformer or inductor, the ferrite bodies of the pair of forming members 6 act to form magnetic paths together with the I-type core 8.

In manufacturing the above-described I-type core 8, various types of cores can be used, such as, for example, an air-cored core, a magnetic core, and a dielectric core.

Figure 10:
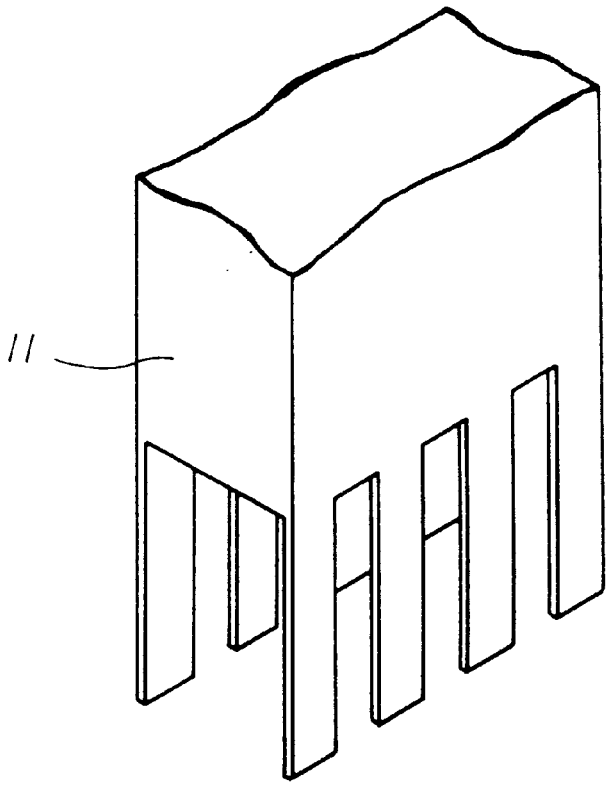
FIG. 10 shows a perspective view of a forming member serving as a jig used in a third embodiment.
Figure 11:
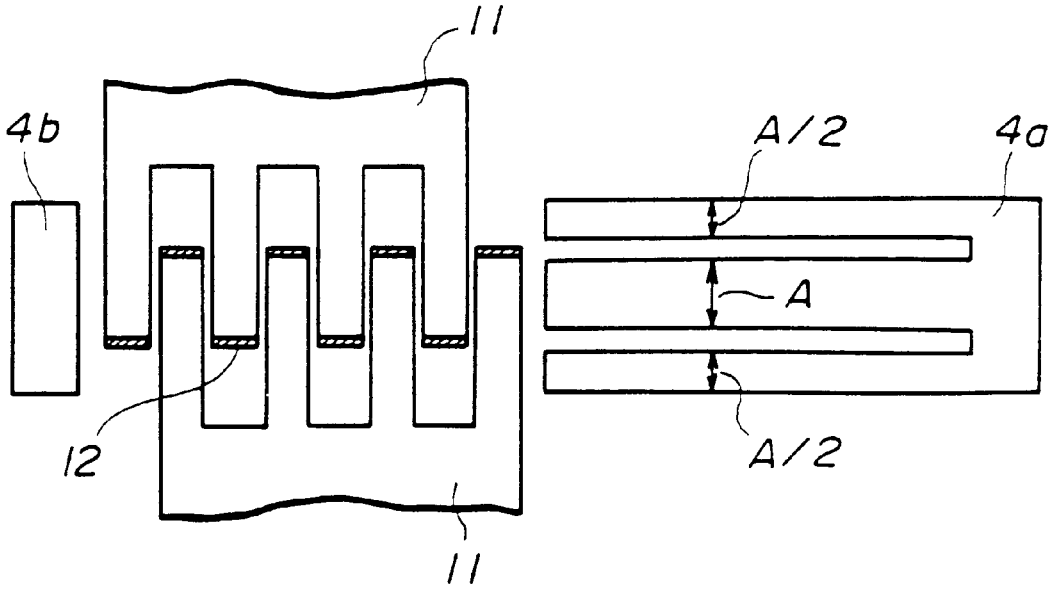
FIG. 11 shows a longitudinal sectional view of either a transformer or an inductor in the third embodiment which is being assembled.

With reference to FIGS. 10 and 11, either a transformer or an inductor and a transformer or inductor manufacturing method in a third embodiment of the present invention will now be described. In manufacturing the transformer or inductor in the third embodiment, a pair of forming members 11, one of which is shown in FIG. 10 are used is jigs. The transformer or inductor in the third embodiment uses a folded patterned foil member 12 such as, for example, the folded patterned foil member 10 shown in FIG. 2. Then, similarly to the above-described coil bobbin assembly forming process of the transformer in the first embodiment, the pair of forming members 11 together sandwich and press the folded patterned foil member 12 therebetween as teeth of one member are engaged with those of the other member. Thus, a coil is formed from the folded patterned foil member 12. Then, the EI core 4*a* and 4*b* is integrated with the thus-formed coil 12 as shown in FIG. 11 similarly to the above-described process of integrating the core with the coil bobbin assembly in the first embodiment. After that, the forming members 11 may be removed from the thus-assembled coil 12 and core 4*a* and 4*b*.

As shown in the above-described embodiments of the present invention, and in the manufacturing methods according to the present invention, a folded patterned foil member can be easily formed. Further, a coil can also be very easily formed from the folded patterned foil member simply as a result of the folded patterned foil member being sandwiched and pressed by forming members. Then, after integrating the thus-formed coil with a core, a transformer or an inductor can be thus easily formed. Thus, a tool such as a wire winding machine is not required, and troublesome and complicated manual operations are not required. Therefore, the transformer or inductor manufacturing methods according to the present invention are superior methods.

The present invention can also be applied to a case where a transformer or an inductor is mounted on a printed circuit board. In such a case, predetermined holes are previously formed in a printed circuit board, and forming members sandwich the printed circuit board together with a folded patterned foil member through the thus-formed predetermined holes. By applying such a method, a process in which a transformer or an inductor is mounted onto a printed circuit board can be performed at the same time that the transformer or inductor is formed. Such a method can also be applied to a miniature motor assembly process. Further, by applying such a method, it is easy to connect lead parts of the thus-formed and mounted transformer or inductor with other circuits on the printed circuit board.

Figure 12:
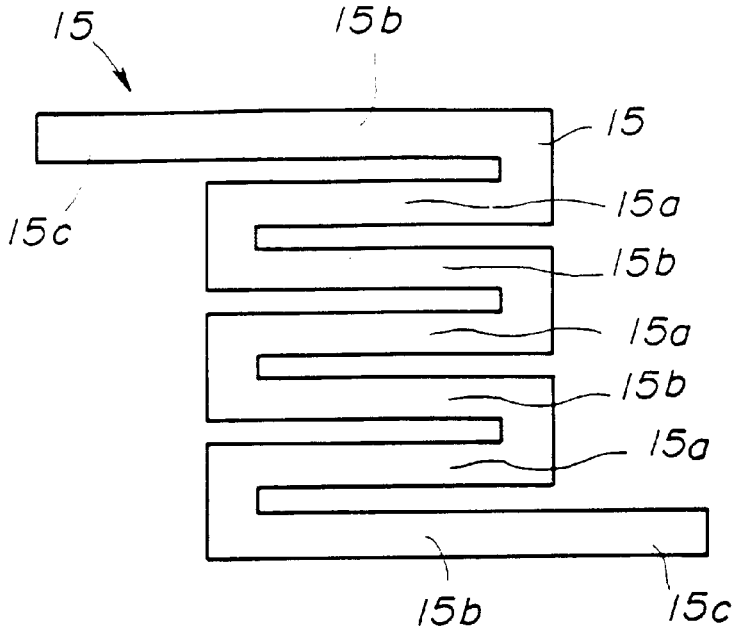
FIG. 12 shows a plan view of a folded patterned foil member used in a fourth embodiment of the present invention.

An inductor is formed and at the same time directly mounted on a printed circuit in a fourth embodiment of the present invention. An inductor and an inductor manufacturing method in the fourth embodiment of the present invention will now be described with reference to FIGS. 12 through 16. In the fourth embodiment, a folded patterned electrically conductive foil member 15, the entire surfaces thereof being electrically insulated, is used. This foil member 15 is formed as a result of, for example, an electrically conductive foil being mounted on a flexible insulated substrate such as an insulating film and then a relevant shape being stamped out from the substrate. Thus, a continuous folded pattern including alternate strip parts and remaining strip parts shown in FIG. 12 is formed in a plane. Each one of the alternate strip parts is arranged adjacent to each one of the remaining strip parts respectively. A process is performed on the thus-formed folded patterned foil member 15 such that the entire surfaces of the foil member 15 are insulated as a result of, for example, coating them with an insulating material.

Figure 13:
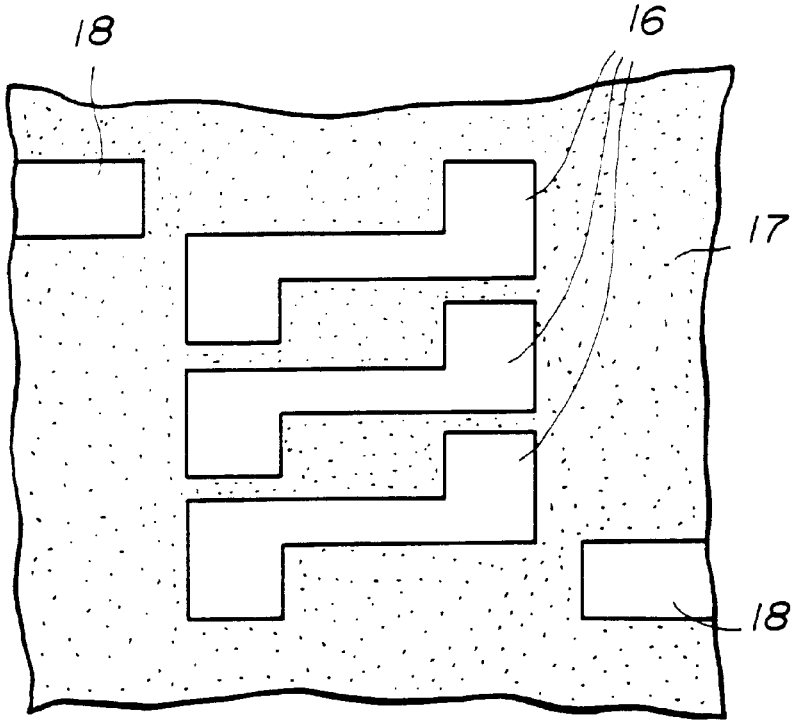
FIG. 13 shows a partial plan view of a printed circuit board used in the fourth embodiment.

As shown in FIG. 13, three through holes 16, each having a shape like the letter Z, are formed in a printed circuit board 17. With reference to FIG. 13, a position of a horizontally extending part of each of the through holes 16 corresponds to a respective one of alternate straightly extending strip parts 15*a* of the foil member 15 shown in FIG. 12. Further, positions of two vertically extending parts of each of the through holes 16 correspond to a pair of bridging parts which connect two ends of a respective one of the alternate strip parts 15*a* to two adjacent straightly extending strip parts 15*b*. The bridging parts are parts extending perpendicular to the strip parts 15*a*. Further, as shown in FIG. 13, silver foil patterns 18 are formed on the printed circuit board 17 in positions corresponding to lead terminal parts 15*c* of the foil member 15 shown in FIG. 12.

Figure 14:
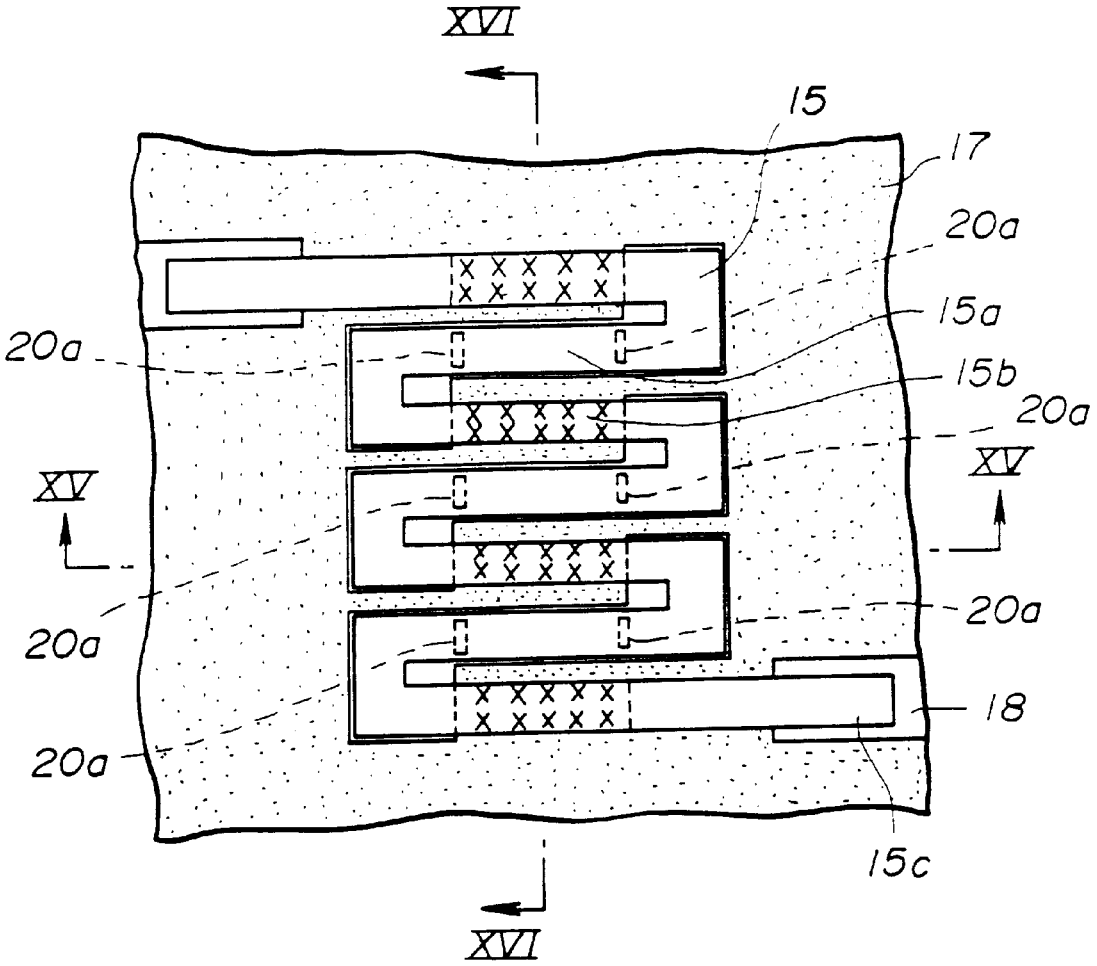
FIG. 14 shows a plan view of an inductor in the fourth embodiment in which the folded patterned foil member has been bonded onto the printed circuit board.

Then, as shown in FIG. 14, the folded patterned foil member 15 is placed on the printed circuit board 17 according to the above-described position correspondences. As a result, each of the alternate strip parts 15*a* is located at a respective one of the horizontally extending parts of the through holes 16, and each of the adjacent remaining strip parts 15*b* is located at a part in the printed circuit board 17 located adjacent to the through holes 16. Then, adhesive is used to bond the foil member 15 with the printed circuit board 17 so that the adjacent remaining strip parts 15*b* of the foil member 15 adhere to the parts of the printed circuit board 17 located adjacent to the through holes 16. The lead terminal parts 15*c* of the foil member 15 are placed on the silver foil patterns 18 and bonded there later.

Figure 15:
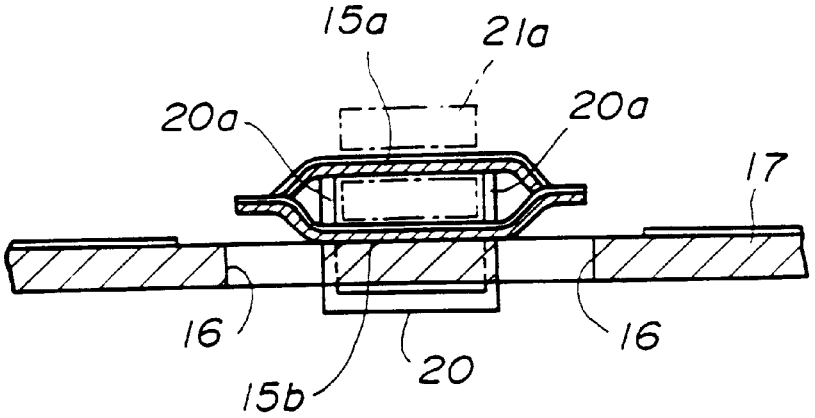
FIG. 15 shows a cross sectional view of the inductor taken along a line XV—XV shown in FIG. 14 in which the coil has been formed from the folded patterned foil member.
Figure 16:
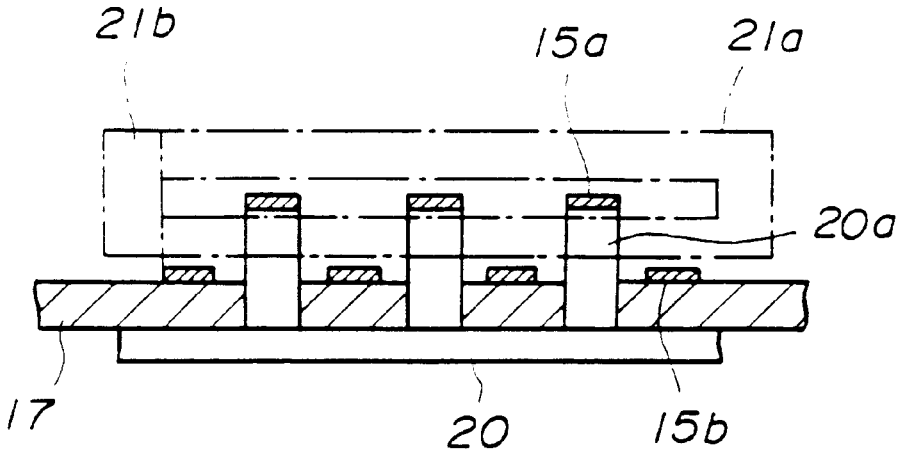
FIG. 16 shows a longitudinal sectional view of the inductor taken along a line XVI—XVI shown in FIG. 14 in which a core has been integrated with the coil.

A forming member 20 is used. The forming member 20 has a plurality of comb teeth. In the embodiment shown in FIG. 14, there are three pairs of comb teeth 20*a*. As shown in FIG. 14, the arrangement of the three pairs of comb teeth 20*a* is such that two extending ends of the comb teeth 20*a* of each pair of the three pairs correspond to a respective one of the alternate strip parts 15*a*. The forming member 20 has a cross sectional view like an angular cornered letter "C" as shown in FIG. 15. As shown in FIG. 15, each pair of the comb teeth 20*a* of the forming member 20 are inserted into a respective one of the through holes 16 from the bottom side of the printed circuit board 17. Then, each pair of comb teeth 20*a* are used to press up a respective one of the alternate strip parts 15*a* so that, as shown in FIG. 15, the alternate strip parts 15*a* are lifted while the adjacent remaining strip parts having adhered to the printed circuit board 17 as mentioned above, remain to the printed circuit board 17. Thus, the foil member 15 is formed into a coil. Then, one extending end of a body 21*a* of a CI core 21*a* and 21*b* is inserted into the thus-formed coil as shown in FIG. 16, and an end plate 21*b* is mounted onto the extending end of the body 21*a*. Then, the forming member 20 may be removed. Thus, the inductor consisting of the coil 15 and the core 21*a* and 21*b* is formed and is at the same time directly mounted on the printed circuit board 17. Further, the lead terminal parts 15*c* are bonded onto the silver foil member patterns 15 as shown in FIG. 14. Thus, according to the present invention, it is easy to form and mount an inductor onto a printed circuit board, and the handling of lead terminal parts of the inductor is easy.

In manufacturing the above-described CI core (21*a* and 21*b*), various types of cores can be used, such as, for example, an air-cored core, a magnetic core, and a dielectric core.

Figure 17:
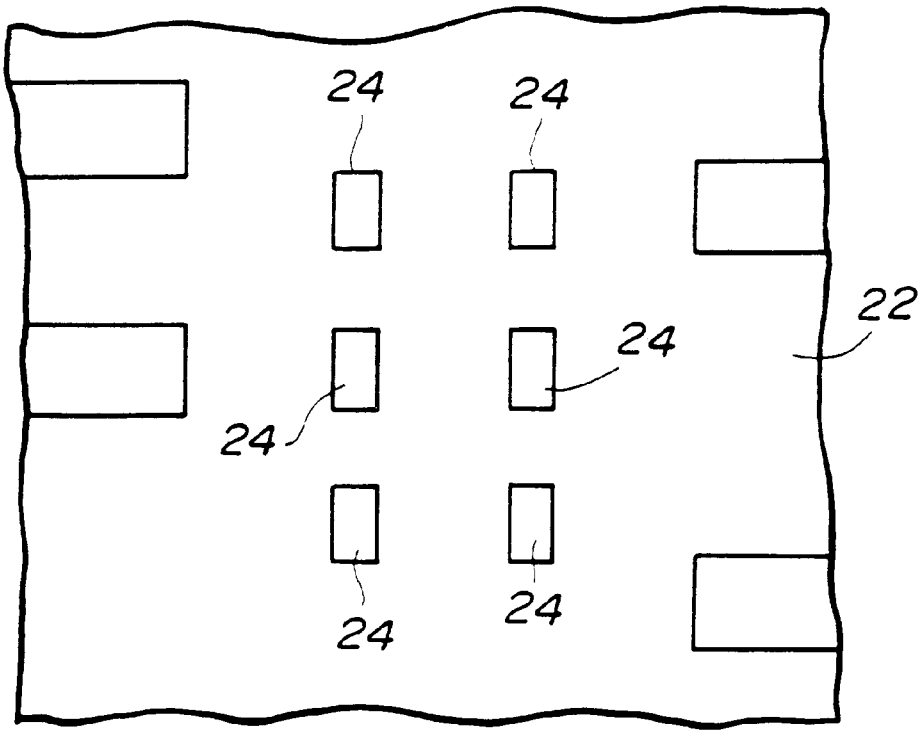
FIG. 17 shows a plan view of a printed circuit board used in a fifth embodiment of the present invention.
Figure 18:
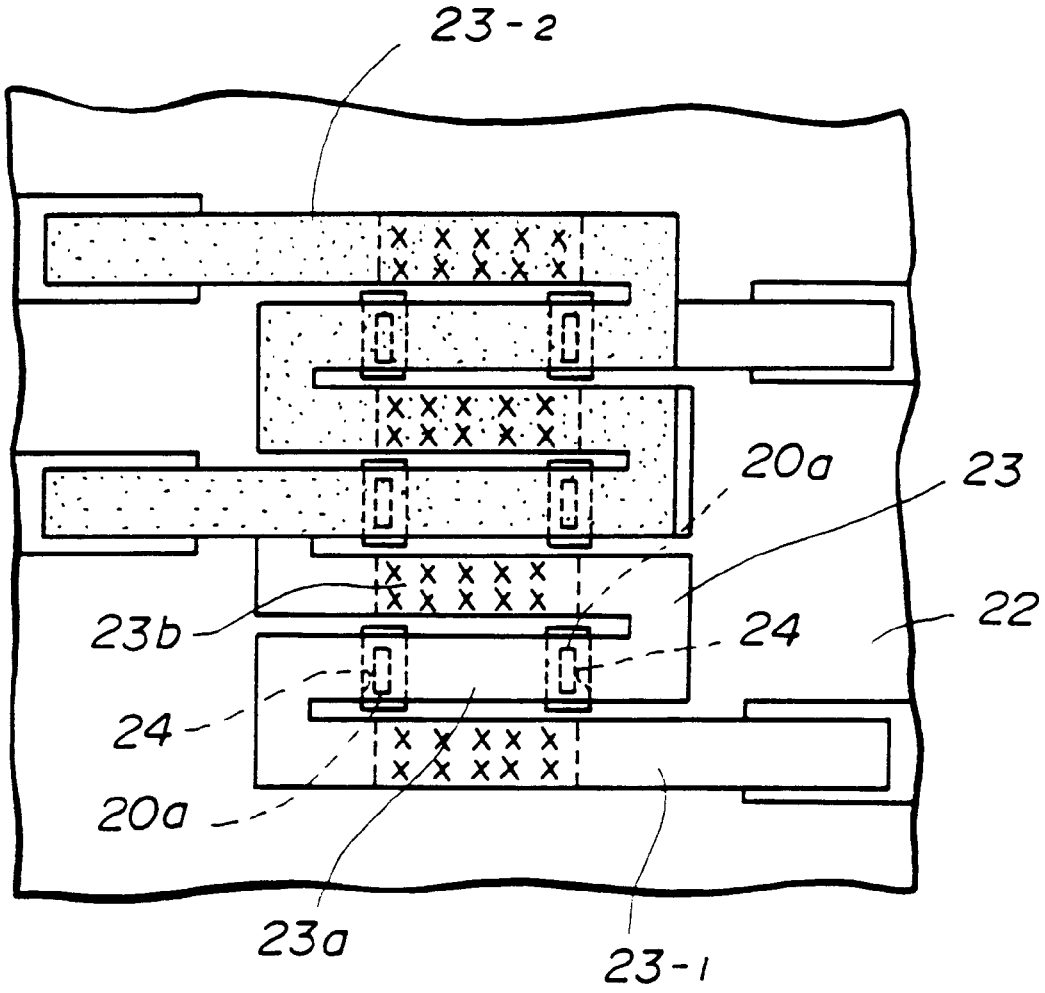
FIG. 18 shows a plan view of a state in which a folded patterned foil member has been bonded onto the printed circuit board in the fifth embodiment of the present invention.

The present invention is not limited to through holes, each having a shape like the letter Z as shown in FIG. 13, formed in a printed circuit board. Any shape of such a through hole is allowed as long as comb teeth of a forming member such as the forming member 20 can be inserted into the through hole. With reference to FIGS. 17 and 18, a transformer and a transformer forming method in a fifth embodiment of the present invention will now be described. In the fifth embodiment, a printed circuit board 22 has three pairs of through holes 24 formed therein, positions of each pair of through holes 14 corresponding to a respective one of alternate straightly extending strip parts 23*a* of a folded patterned insulated electrical conductor foil member 23 as shown in FIG. 18. In the embodiment shown in FIG. 18, the folded patterned foil member 23 includes two layers of continuous folded pattern foil members $\mathbf{23}_{-1}$, and $\mathbf{23}_{-2}$ as in the foils 1 and 2 of the foil member 10 shown in FIG. 2. Similarly to the above-described coil forming process of the fourth embodiment, the alternate strip parts 23*a* are lifted while adjacent remaining straightly extending strip parts 23*b*, having adhered to the printed circuit board 22, remain on the printed circuit board 22. Thus, the foil members $\mathbf{23}_{-1}$ and $\mathbf{23}_{-2}$ are formed into coils, respectively. Thus, the transformer having two windings consisting of the foil members $\mathbf{23}_{-1}$ and $\mathbf{23}_{-2}$ is formed. Thus, according to the present invention, it is easy to form and mount a transformer onto a printed circuit board, and the handling of lead terminal parts of the inductor is easy.

Thus, by the present invention, it is easy to manufacture inductors and transformers which are small in size, light weight and that also have superior frequency characteristics. Further, transformers and inductors, and transformer or inductor manufacturing methods according to the present invention are very suitable for being manufactured in mass production and thus it is possible to greatly reduce the involved. Further, a process for mounting a transformer or an inductor onto a printed circuit board or the like, and a process for connecting lead terminal parts of a transformer or inductor to another circuit in the printed circuit board or the like can be easily performed. Thus, the present invention provides many advantages.

With reference to FIGS. 19, 20, 21A, 21B, 21C, 4, and 22, an inductor in a sixth embodiment of the present invention will now be described. The inductor uses a wiring pattern member 30 shown in FIG. 19. This wiring pattern member 30 has a folded patterned outline the same as the outline of the folded patterned electrical conductor foil 1 of the foil member 10 shown in FIG. 2. For the sake of preventing the figure from being complicated, the outline of the wiring pattern member 30 is indicated using chain lines in FIG. 19.

Figure 19:
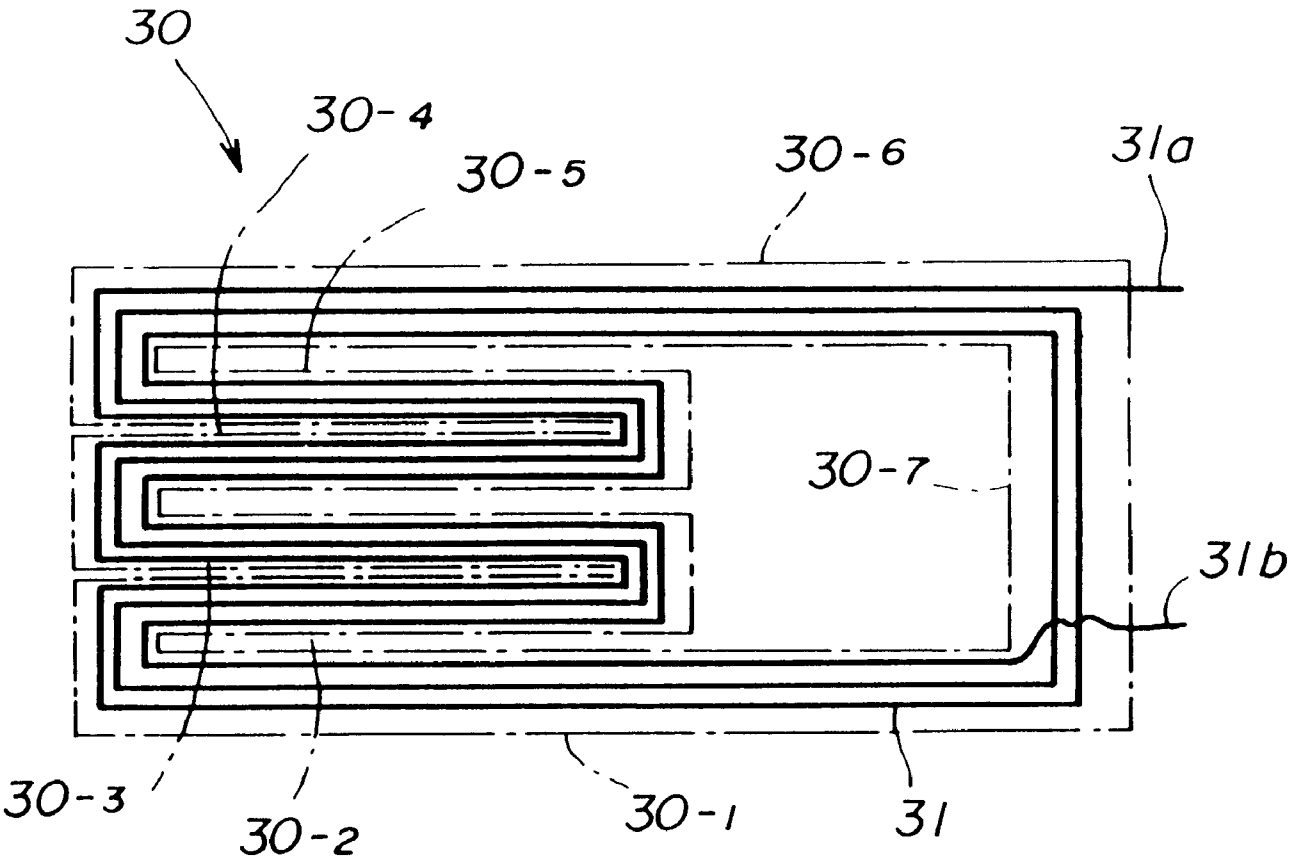
FIG. 19 shows a plan view of a wiring pattern member used in an inductor in a sixth embodiment of the present invention.

The wiring pattern member 30 includes a row of six strip parts $\mathbf{30}_{-1}$, $\mathbf{30}_{-2}$, $\mathbf{30}_{-3}$, $\mathbf{30}_{-4}$, $\mathbf{30}_{-5}$ and $\mathbf{30}_{-6}$ as shown in FIG. 19. Each adjacent pair of strip parts among the six strip parts are connected with each other at the ends thereof so that the wiring pattern member 30 has the a form of a continuous series of five alternating reverse directional bends. With reference to FIG. 19, the right end of the strip part $\mathbf{30}_{-6}$ is connected with the right end of the strip part $\mathbf{30}_{-7}$ via a connecting part $\mathbf{30}_{-7}$. Thus, the wiring pattern member 30 forms a loop including the six strip parts and connecting part.

Further, as shown in FIG. 19, a wiring pattern of an electrical conductor foil is formed in the wiring pattern member 30. Placement of the electrical conductor foil is started at a starting end 31*a* from the right end of the top strip part $\mathbf{30}_{-6}$. Then, the electrical conductor foil extends along the strip part $\mathbf{30}_{-6}$ leftward, and then it extends downward to enter the subsequent strip part $\mathbf{30}_{-5}$. Then, the electrical conductor foil extends along the strip part $\mathbf{30}_{-5}$ rightward. Thus, the electrical conductor foil extends along and thus is circulated through the series of alternating reverse directional bends of the wiring pattern member 30. Then, after extending along the bottom strip part $\mathbf{30}_{-1}$, rightward, the electrical conductor foil extends along the connecting part $\mathbf{30}_{-7}$ upward, and then again extends along the top strip part $\mathbf{30}_{-6}$. Thus, the electrical conductor foil is circulated through the above-mentioned loop including the series of alternating reverse directional bends.

Similarly, the electrical conductor foil used to form the wiring pattern 31 further extends along and thus is circulated through the loop a certain number of times. However, while extending the foil, the currently extending part of the electrical conductor foil does not electrically come into contact with any part of the electrical conductor foil which was extended in a previous revolution. In the embodiment shown in FIG. 19, the electrical conductor foil extends along and thus is circulated through the loop approximately three times in total. Then, the extension of the electrical conductor foil is ended at an extending end 31*b*. The wiring pattern 31 shown in FIG. 19 is thus formed. The wiring pattern 31 which is a winding of the inductor is thus obtained. The wiring pattern 31 is such that if the folded pattern of the wiring pattern member 30 is straightened, the wiring pattern 31 becomes a spiral form starting from an inner end corresponding to the end 31*b* and ending at an outer end corresponding to the end 31*a*.

The wiring pattern member 30 can be formed in a process similar to a process for forming a conventional flexible printed circuit board. Specifically, the wiring pattern 31 can be formed as a result of an appropriate mask being placed on a flexible insulating substrate. Then, the wiring pattern 31 is formed thereon in a well-known photo etching method. Then, the outline of the wiring pattern member 30 can be obtained as a result of cutting the substrate by performing a pressing processing. After that, the entire surfaces of the processed substrate are insulated by an insulating film or the like.

Then, the thus-formed wiring pattern member 30 is processed to form a coil of the inductor. The illustration shown in FIG. 21A is similar to the illustration shown in FIG. 6, and the illustration shown in FIG. 21B is similar to the illustration shown in FIG. 7. As shown in FIG. 21B, using a pair of forming member 33*a* and 33*b* shown in FIG. 20, and similarly to the above-described coil bobbin assembly forming process of the transformer in the first embodiment, the pair of forming members 33*a* and 33*b* together sandwich and press the wiring pattern member 30 therebetween as teeth of one member are engaged with those of the other member. As a result of the teeth of the forming members 33*a* and 33*b* pressing the strip parts $\mathbf{30}_{-1}$, through $\mathbf{30}_{-6}$, each of alternate strip parts $\mathbf{30}_{-2}$, $\mathbf{30}_{-4}$, and $\mathbf{30}_{-6}$ is lifted and each of adjacent remaining strip parts $\mathbf{30}_{-1}$, $\mathbf{30}_{-3}$, and $\mathbf{30}_{-5}$ is lowered as shown in FIGS. 21B and 21C.

Thus, a coil is formed from the wiring pattern 31 of the wiring patterned member 30 as shown in FIG. 21B. In the coil shown in FIG. 21B, 3 winding turns are obtained from each one extension of the winding pattern along the entire path of the above-mentioned loop of the wiring pattern member 30. Thus, 9 winding turns can be obtained in total from the three extension of the winding pattern along the entire path of the loop. Thus, a coil bobbin assembly consisting of the coil of the wiring pattern member 30 and a bobbin of the forming members 33*a* and 33*b* is formed.

Figure 22:
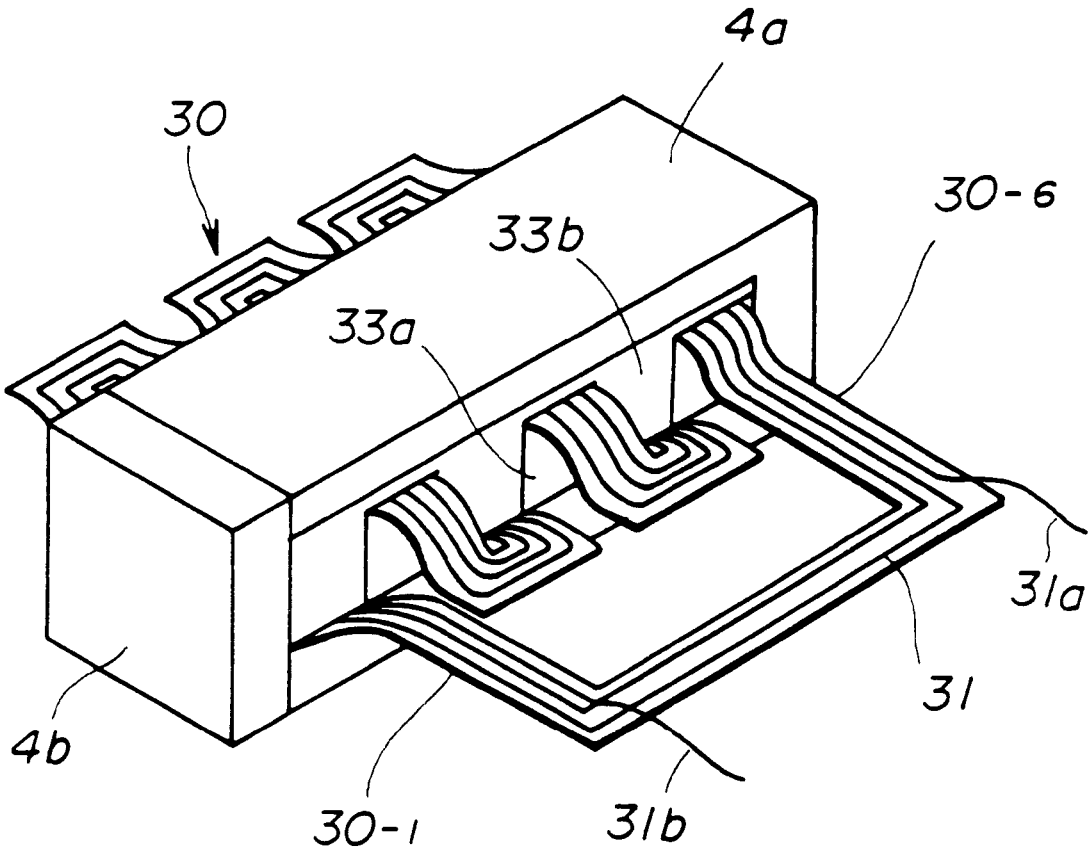
FIG. 22 shows a perspective view of the inductor in the sixth embodiment.

Then, similarly to a process for integrating the EI core with the coil bobbin assembly shown in FIG. 6, the EI core 4*a* and 4*b* shown in FIG. 4 is integrated with the thus-formed coil bobbin assembly as shown in FIG. 22.

Figure 20:
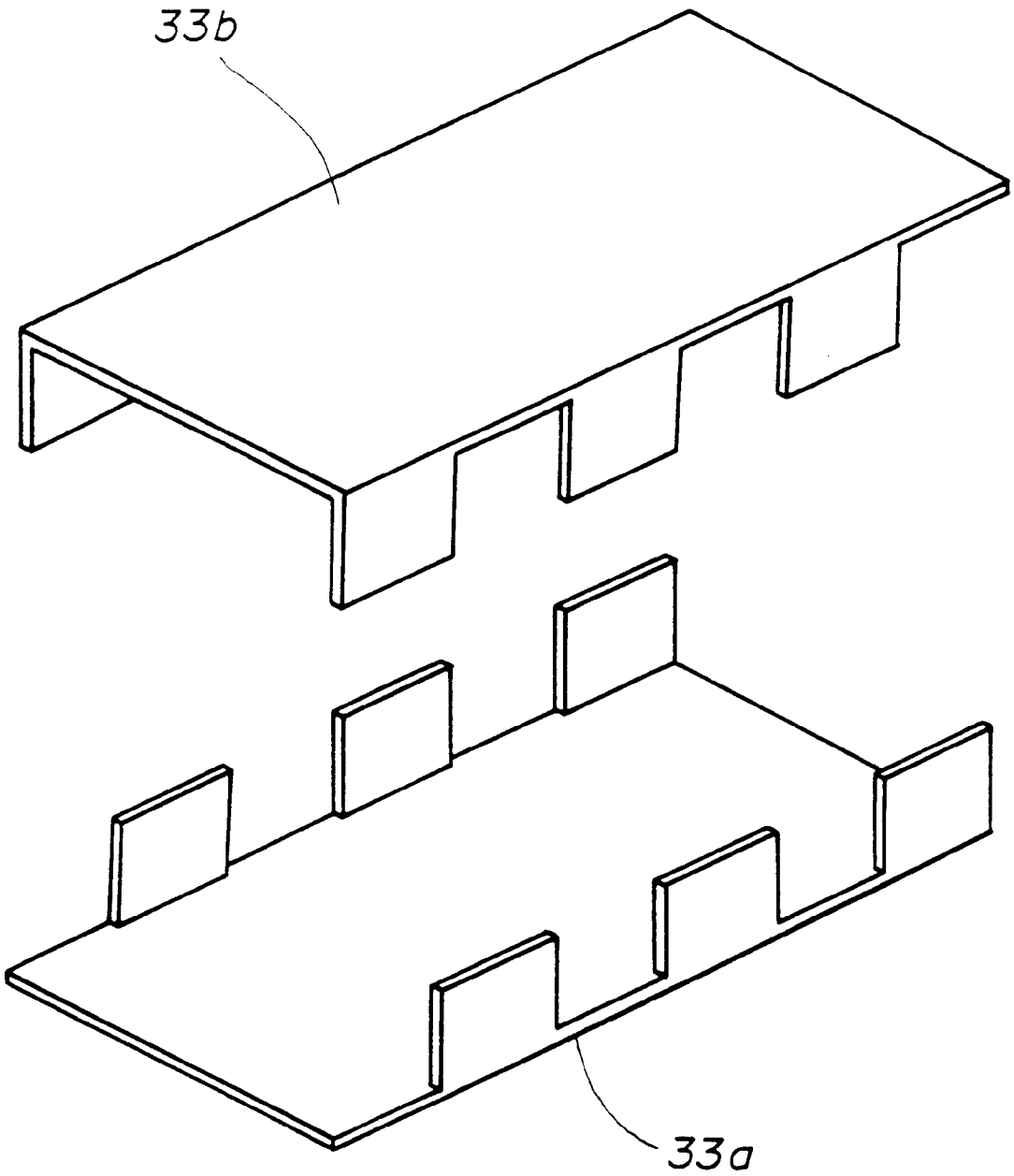
FIG. 20 shows a perspective view of a pair of forming members used in the inductor in the sixth embodiment.
Figure 21A:
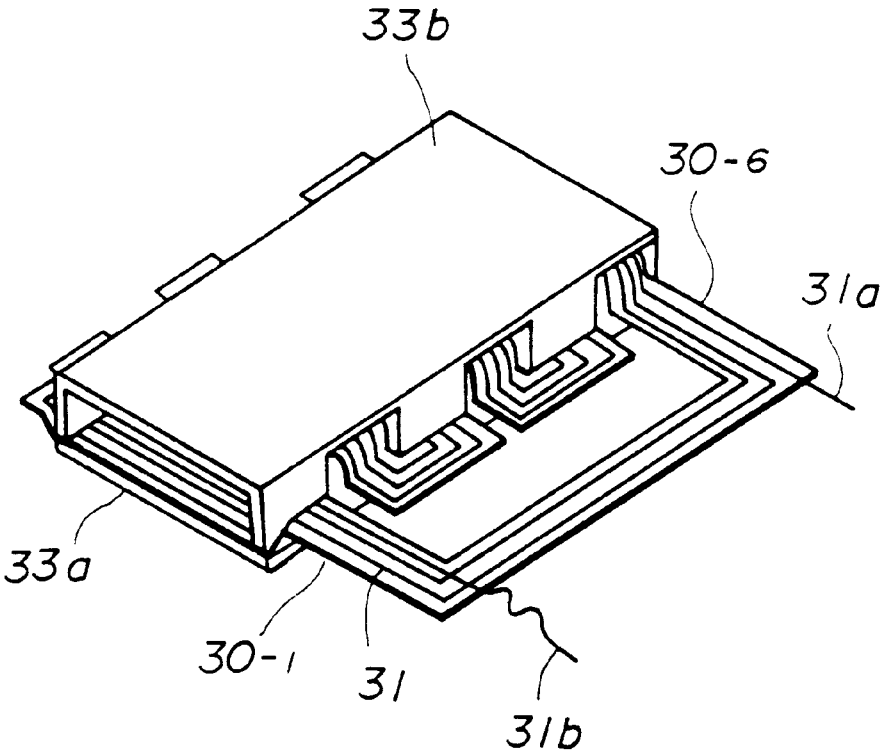
FIG. 21A shows a perspective view of a state in which the wiring pattern member has been sandwiched by the pair of forming members so as to form the inductor in the sixth embodiment.
Figure 21B:
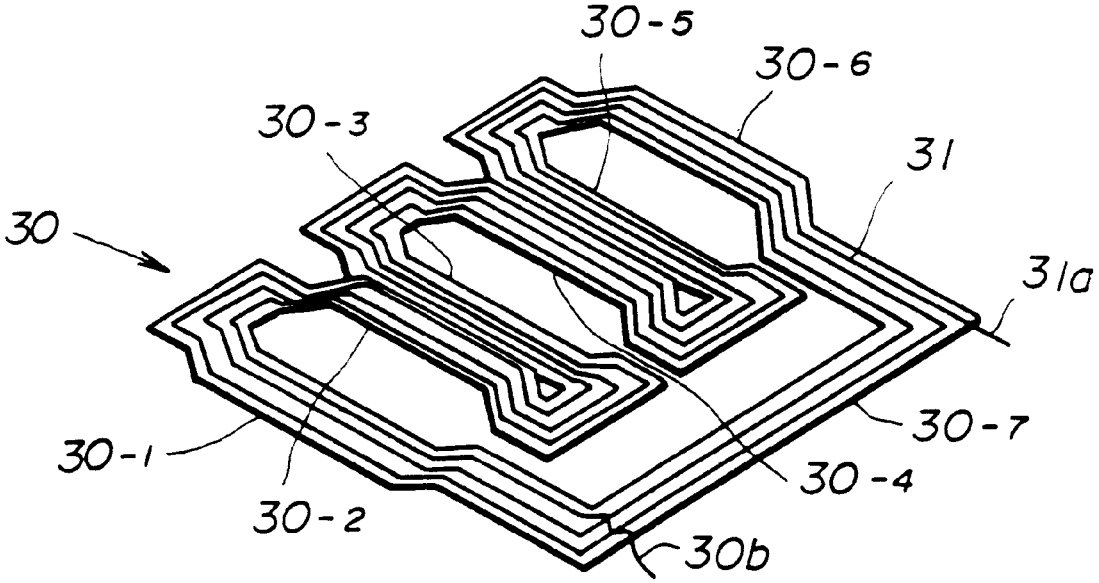
FIG. 21B shows a perspective view of the wiring pattern member shown in FIG. 19 deformed to form a coil.
Figure 21C:
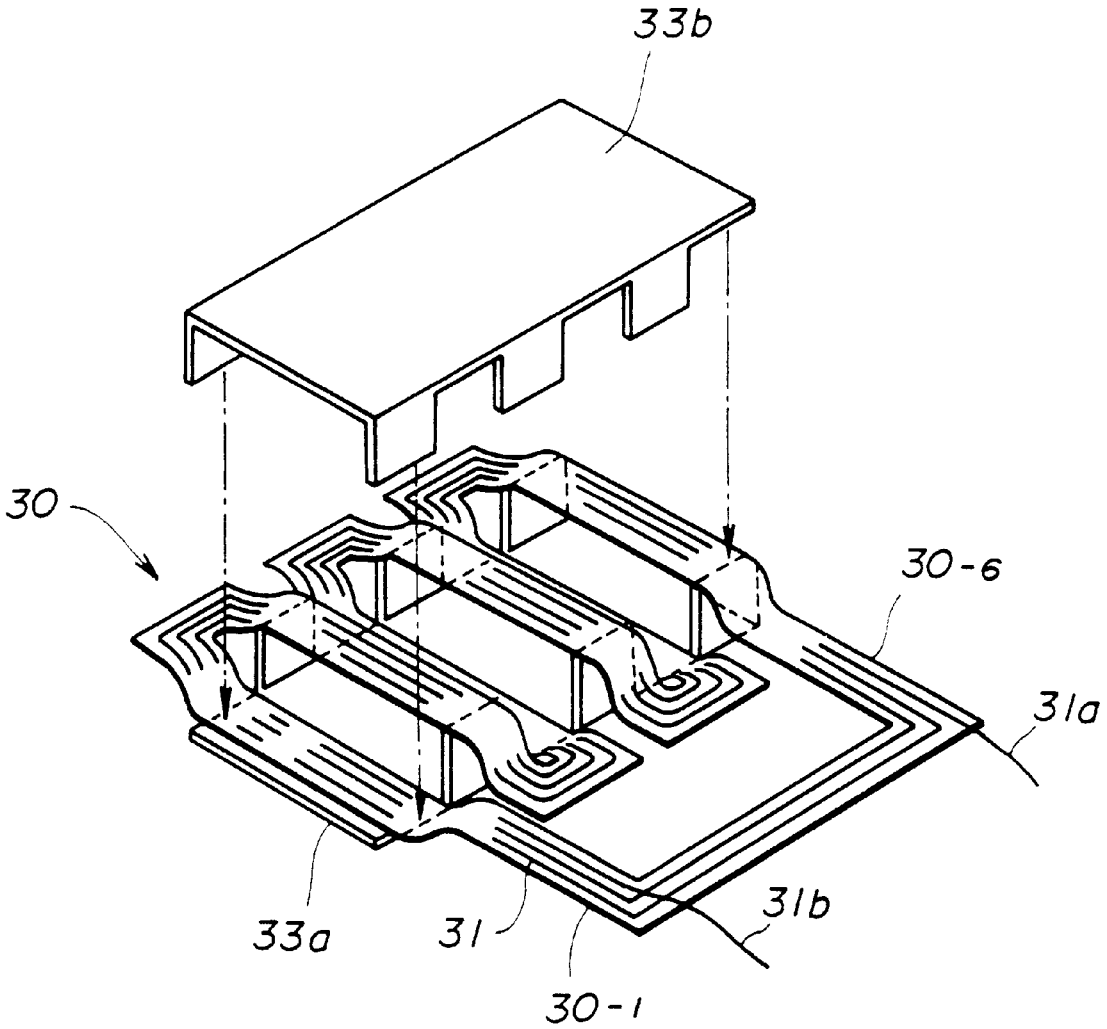
FIG. 21C shows a perspective view of the wiring pattern member and the pair of forming members shown in FIG. 21A in a state in which a top one of the pair of forming members has been removed after the deformation of the wiring pattern member.

The pair of forming members 33*a* and 33*b* shown in FIG. 20 are made of an insulating material such as a plastic and are used as the bobbin of the inductor. However, as described with reference to FIG. 8, the pair of forming members 33*a* and 33*b* may be made from a magnetic material such as ferrite.

According to the present invention, it is possible to effectively increase a number of winding turns in a coil of an inductor as described above for the sixth embodiment. Thus, an inductor having a high inductance can be provided.

The present invention is not limited to a use of a flexible substrate such as that mentioned above for forming a wiring pattern member such as that shown in FIG. 19. It is also possible to use a rigid substrate or a semi-rigid substrate having a shape such as that shown in FIG. 21B to form a wiring pattern member such as that shown in FIG. 21B.

With reference to FIGS. 23A, 23B, 23C, 24, 25, 26 and 27, a transformer in a seventh embodiment of the present invention will now be described.

Figure 23A:
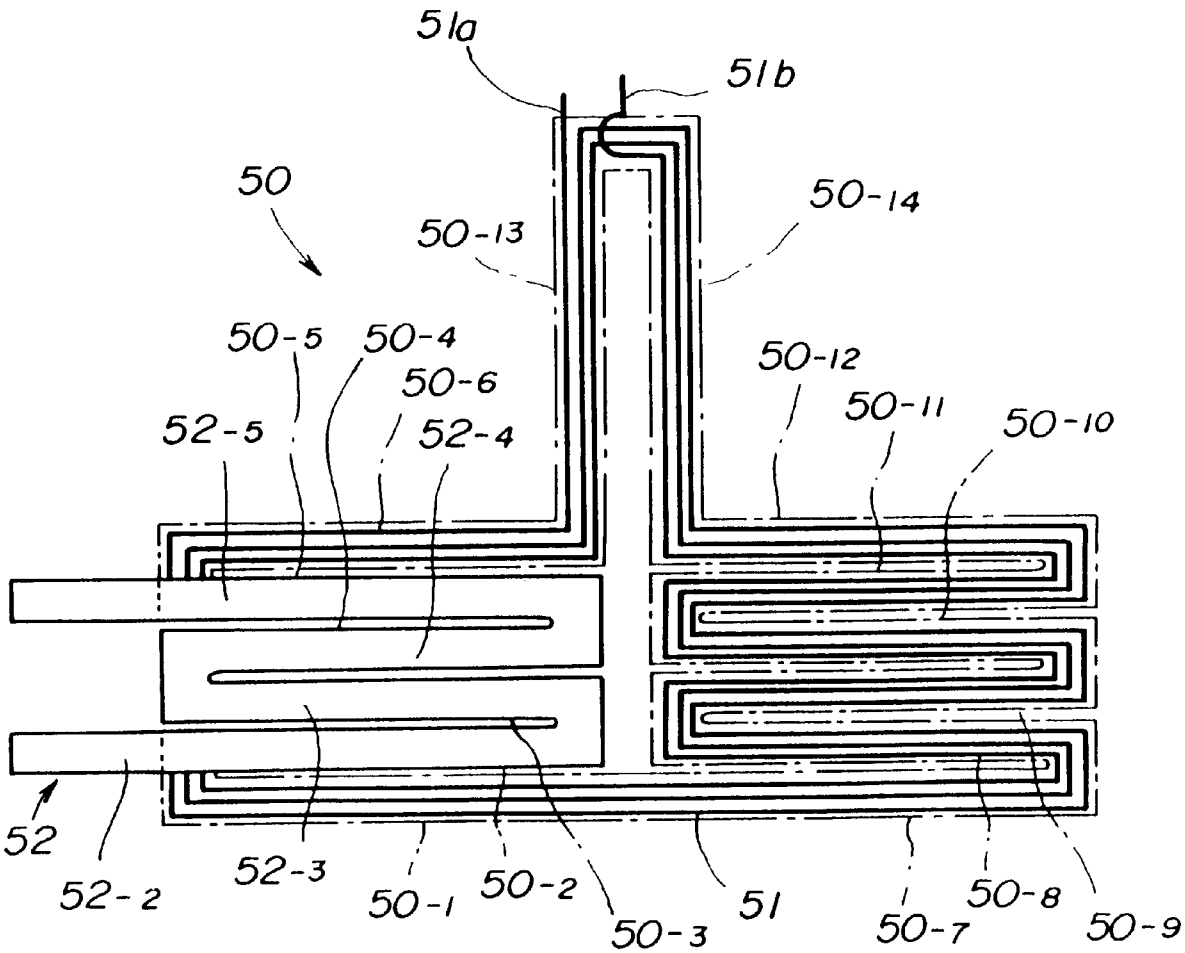
FIG. 23A shows a plan view of an integrated body of a wiring pattern member and an electrical conductor foil member used in a transformer in the seventh embodiment of the present invention.

With reference to FIG. 23A, a wiring pattern member 50 and an electrical conductor foil member 52 will now be described. The electrical conductor foil member 52 has a folded patterned form and thus is substantially the same as the electrical conductor foil 2 of the foil member 10 shown in FIG. 2. The electrical conductor foil 52 includes four strip parts 52-2, 52-3, 52-4, and 52-5.

The wiring pattern member 50 includes 12 strip parts $\mathbf{50}_{-1}$, $\mathbf{50}_{-2}$, $\mathbf{50}_{-3}$, $\mathbf{50}_{-4}$, $\mathbf{50}_{-5}$, $\mathbf{50}_{-6}$, $\mathbf{50}_{-7}$, $\mathbf{50}_{-8}$, $\mathbf{50}_{-9}$, $\mathbf{50}_{-10}$, $\mathbf{50}_{-11}$, and $\mathbf{50}_{-12}$. As shown in FIG. 23A, the left side 6 strip parts $\mathbf{50}_{-1}$ through $\mathbf{50}_{-6}$ have a folded patterned form and thus are substantially the same as the 6 strip parts $\mathbf{30}_{-1}$ through $\mathbf{30}_{-6}$ shown in FIG. 19. Similarly, the right 6 strip parts $\mathbf{50}_{-7}$ through $\mathbf{50}_{-12}$ also have a similar folded patterned form and thus are substantially the same as the 6 strip parts $\mathbf{30}_{-1}$ through $\mathbf{30}_{-6}$.

A folded patterned form consisting of the strip parts $\mathbf{52}_{-2}$, $\mathbf{52}_{-3}$, $\mathbf{52}_{-4}$, and $\mathbf{52}_{-5}$ of the electrical conductor foil 52 are the same as a folded patterned form consisting of the four strip parts $\mathbf{50}_{-2}$, $\mathbf{50}_{-3}$, $\mathbf{50}_{-4}$, and $\mathbf{50}_{-5}$ of the wiring pattern member 50. The strip parts $\mathbf{52}_{-2}$, $\mathbf{52}_{-3}$, $\mathbf{52}_{-4}$, and $\mathbf{52}_{5}$ of the electrical conductor foil 52 are bonded onto the four strip parts $\mathbf{50}_{-2}$, $\mathbf{50}_{-3}$, $\mathbf{50}_{-4}$, and $\mathbf{50}_{-5}$ of the wiring pattern member 50. Thus, each of the strip parts $\mathbf{52}_{-2}$, $\mathbf{52}_{-3}$, $\mathbf{52}_{-4}$, and $\mathbf{52}_{-5}$ of the electrical conductor foil 52 is overlapped with the respective strip part of the four strip parts $\mathbf{50}_{-2}$, $\mathbf{50}_{-3}$, $\mathbf{50}_{-4}$, and $\mathbf{50}_{-5}$ of the wiring pattern member 50. Thus, the outline of the folded patterned form of the four strip parts of the electrical conductor foil 52 overlaps the outline of the folded patterned form of the four strip parts 15 of the wiring pattern member 50. As a result, the figures do not actually show the four strip parts $\mathbf{50}_{-2}$, $\mathbf{50}_{-3}$, $\mathbf{50}_{-4}$, and $\mathbf{50}_{-5}$.

Further, as shown in the figure, the right end of the bottom left strip part $\mathbf{50}_{-1}$ is connected with the left end of the bottom right strip parts $\mathbf{50}_{-7}$. Further, the three parallel lines of an electrical conductor foil that form a wiring pattern 31 in the strip part $\mathbf{50}_{-1}$ are electrically connected with the three parallel lines of the electrical conductor foil in the strip part $\mathbf{50}_{-7}$, respectively.

The right end of the top left strip part $\mathbf{50}_{-6}$ further extends upward so as to form a lead part $\mathbf{50}_{-13}$. Similarly, the left end of the top right strip parts $\mathbf{50}_{-12}$ also further extends upward so as to form a lead part $\mathbf{50}_{-14}$. Further, two lines of three lines of the electrical conductor foil in the lead part $\mathbf{50}_{-13}$ are electrically connected with two lines of three lines of the electrical conductor foil in the lead part $\mathbf{50}_{-14}$, respectively. A free end of the remaining one line of the electrical conductor foil in the lead part $\mathbf{50}_{-13}$ forms a lead terminal part 51*a*. Similarly, a free end of the remaining one line of the electrical conductor foil in the lead part $\mathbf{50}_{-14}$ forms a lead terminal part 51*b*.

Similar to the wiring pattern 31, the wiring pattern 51 is such that if the folded pattern of the wiring pattern member 50 is straightened, the wiring pattern 51 becomes a spiral form starting from an inner end corresponding to the end 51*b* and ending at an outer end corresponding to the end 51*a*.

Figure 23B:
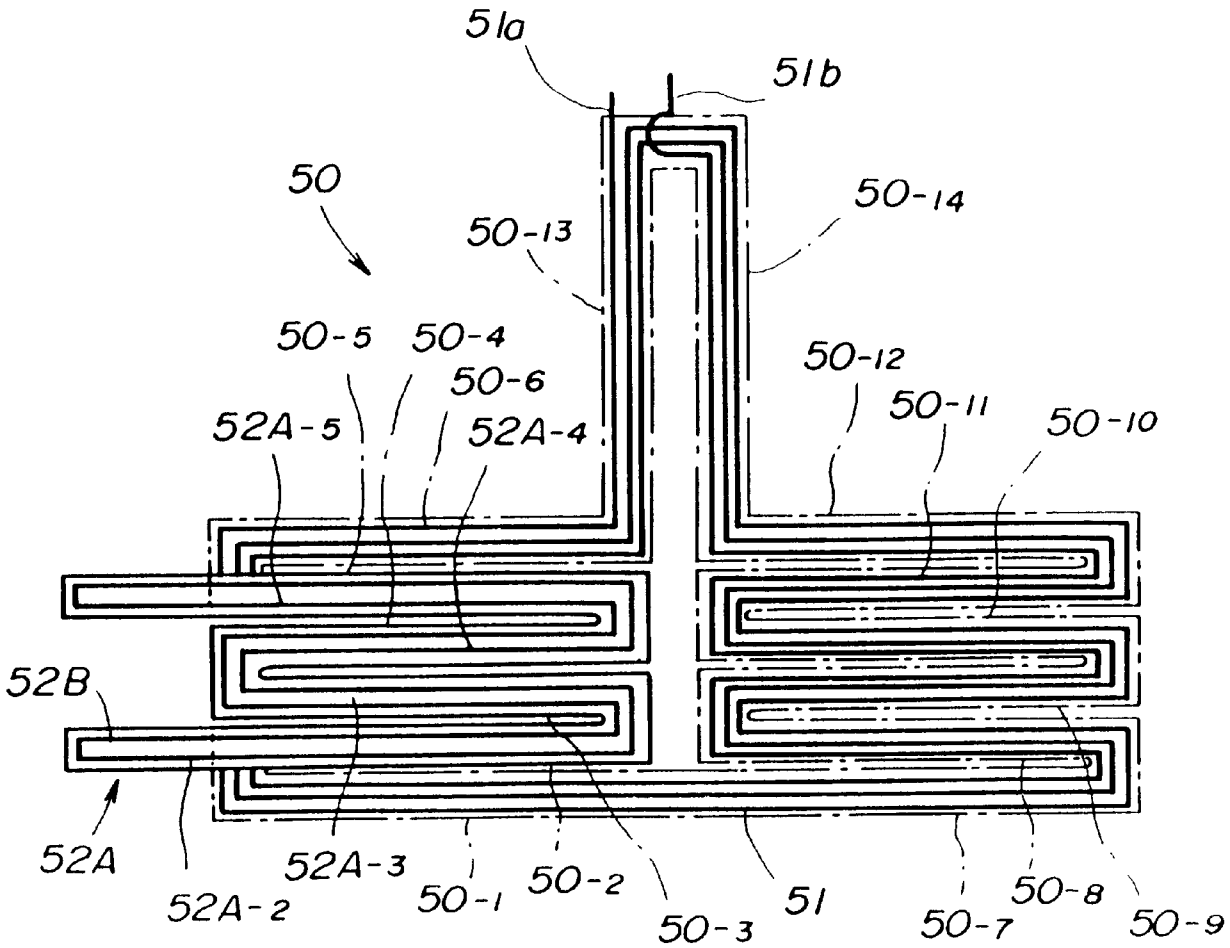
FIG. 23B shows a plan view of an integrated body of a first and second wiring pattern members used in a transformer in a first variant of the seventh embodiment of the present invention.

A member to be bonded onto the pattern wiring member 50 is not limited to an electrical conductor foil such as that 52. As shown in FIG. 23B, instead of the electric conductor foil 52, it is also possible to provide another wiring pattern member 52A in which a single line of an electrical conductor foil 52B extends along a folded pattern of the wiring pattern member 52A. An outward form of the wiring pattern member 52A is the same as the electrical conductor foil 52. The wiring pattern member 52A may be formed in a manner similar to the above-described manner of forming the wiring pattern member 30 shown in FIG. 19. The wiring pattern member 52A is bonded onto the wiring pattern member 50 in a manner the same as the manner of bonding the electrical conductor foil 52 onto the wiring pattern member 50. Thus, strip parts $\mathbf{52A}_{-2}$, $\mathbf{52A}_{-3}$, $\mathbf{52A}_{-4}$ and $\mathbf{52A}_{-5}$ are bonded onto the strip parts $\mathbf{50}_{-2}$, $\mathbf{50}_{-3}$, $\mathbf{50}_{-4}$ and $\mathbf{50}_{-5}$, respectively.

Figure 23C:
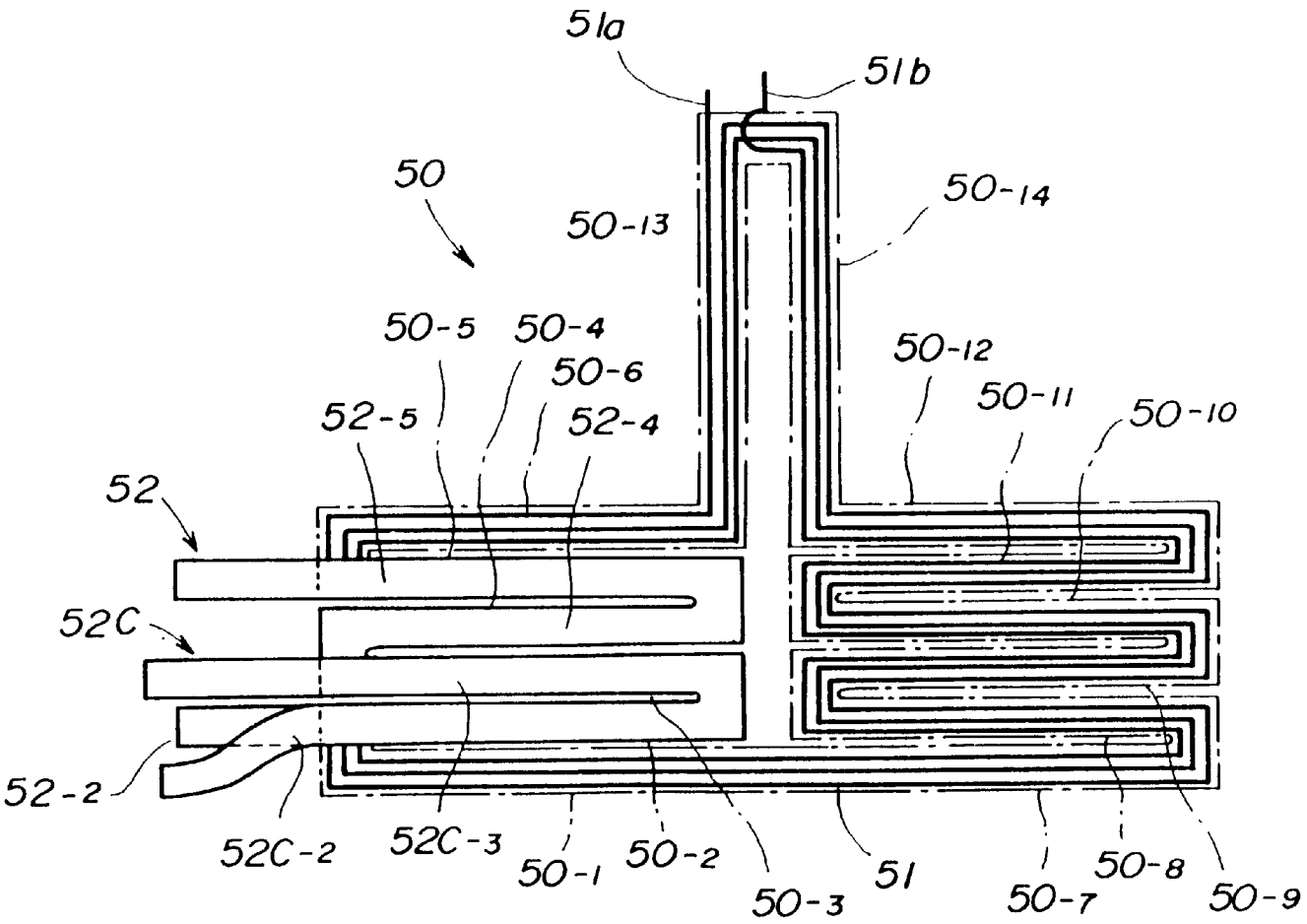
FIG. 23C shows a plan view of an integrated body of a wiring pattern member, an electrical conductor foil member, and either a second wiring pattern member or a second electrical conductor foil member used in a transformer in a second variant of the seventh embodiment of the present invention.

Further, the number of layers to be bonded onto the pattern wiring member 50 is not limited to a single layer. It is also possible to provide a plurality of layers of members being bonded onto the wiring pattern member 50. For example, as shown in FIG. 23C, a member 52C is bonded onto the electrical conductor foil member 52 which was previously bonded onto the wiring pattern member 50. The member 52C may consist of either an electrical conductor foil member such as the electrical conductor foil member 52 or another wiring pattern member such as the wiring pattern member 52A shown in FIG. 23B. The member 52C is bonded onto the electrical conductor foil member 52 in a manner the same as the manner of bonding the electrical conductor foil member 52 onto the wiring pattern member 50. Thus, strip parts $\mathbf{52C}_{-2}$ and $\mathbf{52C}_{-3}$ are bonded onto the strip parts $\mathbf{52}_{-2}$ and $\mathbf{52}_{-3}$, respectively.

Figure 24:
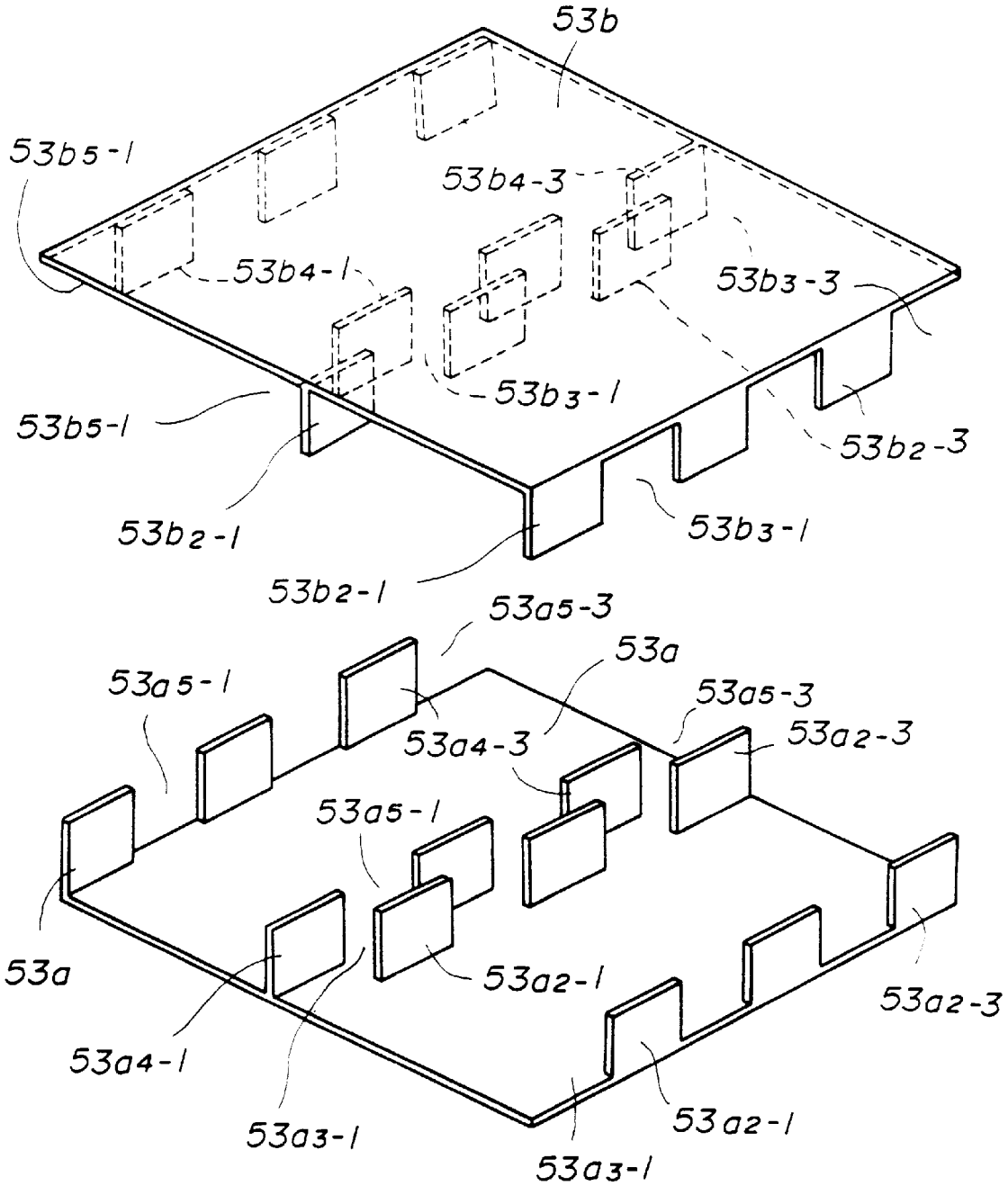
FIG. 24 shows a perspective view of a pair of forming members used in the transformer in the seventh embodiment.

With reference to FIG. 24, a pair of forming members 53*a* and 53*b* will now be described. As shown in FIG. 24, each of the forming member 53*a* and 53*b* has 2 rows of comb teeth pairs, $\mathbf{53}a_{2-1}$ through $\mathbf{53}a_{2-3}$, $\mathbf{53}a_{4-1}$ through $\mathbf{53}a_{4-3}$, $\mathbf{53}b_{2-1}$ through $\mathbf{53}b_{2-3}$, and $\mathbf{53}b_{4-1}$ through $\mathbf{53}b_{4-3}$, each comb tooth thereof extending toward other forming member, each row thereof including 3 comb teeth pairs. Two comb teeth of each comb teeth pair are opposed to each other. Adjacent to each comb tooth thereof, a space having a width substantially the same as a width of the comb tooth is provided. Thus, there are 2 rows of space pairs, 53$a_{3-1}$ through 53$a_{3-3}$, 53$a_{5-1}$ through 53$a_{5-3}$, 53$b_{3-1}$ through 53$b_{3-3}$, and 53$b_{5-1}$ through 53$b_{5-3}$.

How these comb teeth pairs and spaces are arranged will now be described. In each of the forming members 53*a* and 53*b*, each comb teeth pair are aligned with a respective space pair along a direction perpendicular to a direction of each row of comb teeth pairs. For example, the comb teeth pair 53$a_{4-1}$ are aligned with the space pair 53$a_{3-1}$.

Figure 25:
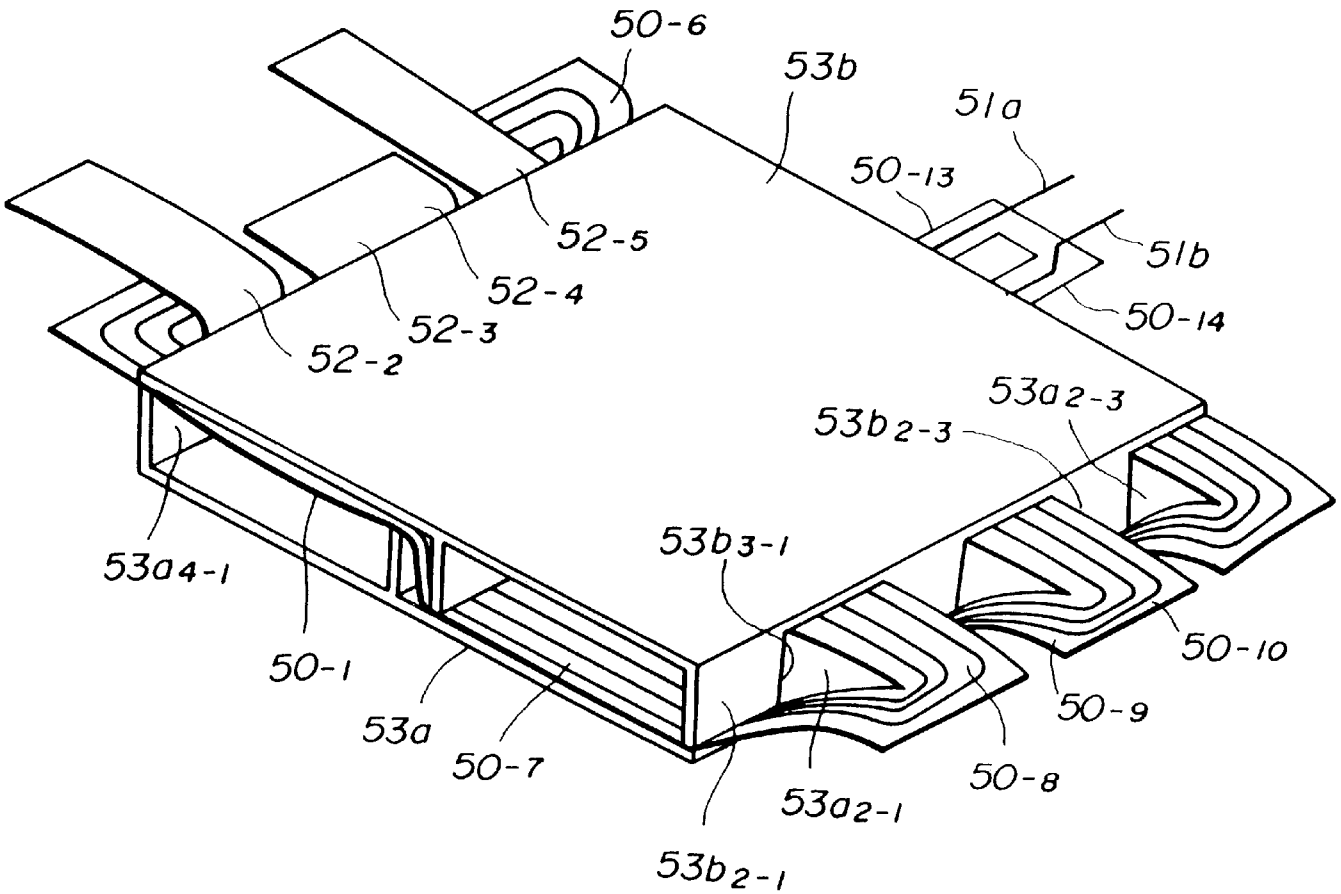
FIG. 25 shows a state in which the integrated body shown in FIG. 23A has been sandwiched by the pair of forming members shown in FIG. 24.

As shown in FIG. 25, an integrated body of the wiring pattern member 50 and electrical conductor foil member 52 shown in FIG. 23A is placed on the bottom forming member 53*a* and the top forming member 53*b* is pressed down onto the integrated body, appropriately. Thus, the integrated body is sandwiched by the pair of the forming members 53*a* and 53*b* and pressed therebetween. Thus, the comb teeth of the forming member 53*a* are engaged with those of the forming member 53*b* as shown in the figure.

Figure 26:
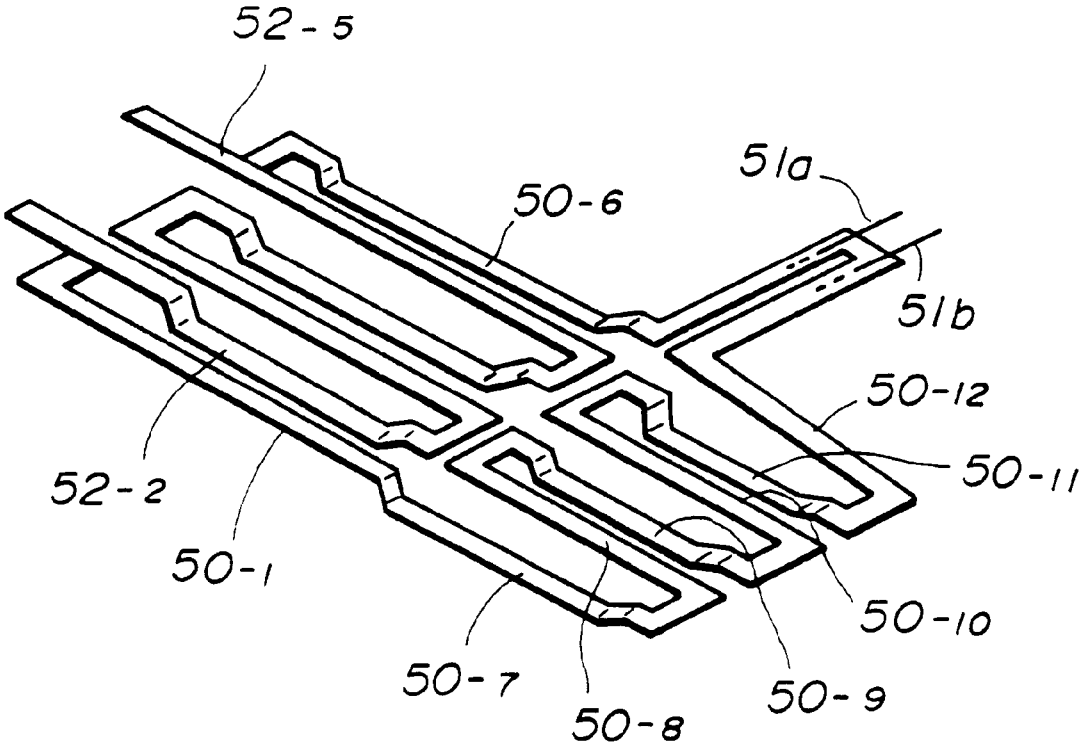
FIG. 26 shows a perspective view of the integrated body shown in FIG. 23A deformed to form a coil.

As a result, a middle part of each of alternate ones of the strip parts of the integrated body of the wiring pattern member 50 and electrical conductor foil member 52 is lowered by a respective pair of comb teeth of the pair of forming members 53*a* and 53*b*. However, a middle part of each of the remaining ones of the strip parts of the integrated body is prevented from being lowered by a respective pair of comb teeth. For example, a middle part of the strip parts 50$_{-7}$ is lowered by the pair of comb teeth 53$b_{2-1}$, a middle part of the strip part 50$_{-1}$ is prevented from being lowered by the pair of comb teeth 53$a_{4-1}$, and a middle part of an integrated strip part of the strip part 50-2 and the strip part 52$_{-2}$ is lowered by the pair of comb teeth 53$b_{4-1}$. Thus, the integrated body of the wiring pattern member 50 and electrical conductor foil member 52 is deformed as shown in FIG. 26, and thus each adjacent pair of alternate strip part and remaining strip part forms a turn of coil in each of the wiring pattern member 50 and the electrical conductor foil member 52.

Figure 27:
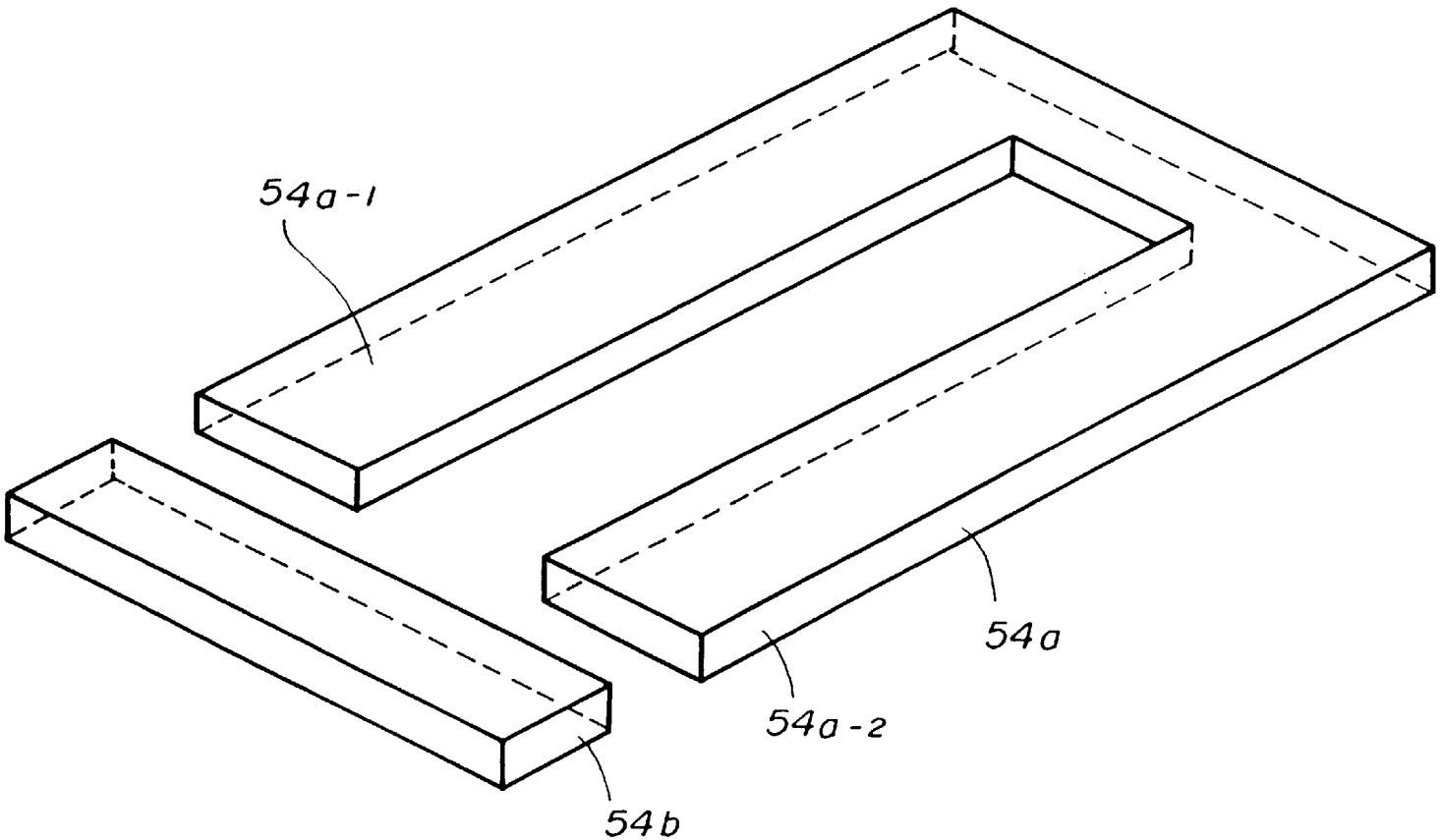
FIG. 27 shows a CI core used in the transformer in the seventh embodiment.

Then, a CI core 54*a* and 54*b* shown in FIG. 27 is integrated with a thus-formed coil bobbin assembly shown in FIG. 25. In the integration, an extending arm 54$a_{-2}$ of a core body 54*a* is passed through a space formed between the lowered middle parts of alternate three strip parts 50$_{-7}$, 50$_{-9}$, 50$_{-11}$ and the remaining three strip parts 50$_{-8}$, 50$_{-10}$, 50$_{-12}$. Similarly, the other extending arm 54$a_{-1}$ of the core body 54*a* is passed through a space formed between the lowered middle parts of the alternate three strip parts 50$_{-2}$ (with 52$_{-2}$), 50$_{-4}$ (with 52$_{-4}$), 5$_{-6}$ and the remaining three strip parts 50$_{-1}$, 50$_{-3}$ (with 52$_{-3}$), 50$_{-5}$ (with 52$_{-5}$). Then, a end part 54*b* of the core is mounted onto extending ends of the extending arms 54$a_{-1}$ and 54$a_{-2}$ of the body 54*a*. Thus, the transformer in the seventh embodiment of the present invention is formed.

In manufacturing the above-described CI core (54*a* and 54*b*), various types of cores can be used, such as, for example, an air-cored core, a magnetic core, and a dielectric core.

The method of forming a transformer using the two bonded wiring pattern members 50 and 52A shown in FIG. 23B is the same as the method of forming the transformer in the seventh embodiment as described above. Similarly, the method of forming a transformer using the bonded wiring pattern member 50, electrical conductor foil member 52, and other member 52C shown in FIG. 23C is the same as the method of forming the transformer in the seventh embodiment as described above.

In this transformer, a primary winding consists of the wiring pattern 51 contained in the wiring pattern member 50, and a secondary winding consists of the electrical conductor foil member 52. Each strip part of the wiring pattern member 50 has therein three parallel lines of the electrical conductor foil of the wiring pattern 51. Thus, each adjacent pair of alternate strip part and remaining strip part of the wiring pattern member forms three winding turns. The wiring pattern member 50 has six adjacent pairs of alternate strip parts and remaining strip parts. Therefore, the primary winding consisting of the wiring pattern member 50 provides 18 winding turns (the result of multiplying 6 by 3).

Further, the electrical conductor foil member 52 has two adjacent pairs of alternate strip parts and remaining strip parts. Therefore, the secondary winding consisting thereof provides 2 winding turns.

Thus, according to the present invention, it is possible to effectively greatly increase a number of winding turns by using such a wiring pattern member having a wiring pattern therein. An advantage of a transformer having a large winding turn number ratio that can be easily obtained is that it can be used to form a transformer used to step down a power frequency voltage into a voltage for driving a logic IC. Specifically, a transformer having a large winding turn number ratio according to the present invention can be used as a main transformer included in an AC/DC converter power source device for the same purpose. In such an application, it is required that a voltage of 141 volts is stepped down into a voltage of 5 or 3 volts. For this purpose, a transformer having a winding turn number ratio of 141/5 or 141/3 is required.

According to the present invention, a transformer having a large winding turn number ratio can be provided at low cost. Thus, an inexpensive power source device can be provided.

Thus, in the present invention, it is easy to form an insulated wiring pattern member having a folded patterned form, each strip part of the form having a plurality of parallel extending lines of electrical conductor foil extending therein. An insulated electrical conductor foil member, acting as second winding, having a folded patterned form may be bonded onto the wiring pattern member acting as a first winding. Further, either the single wiring pattern member or an integrated body of the wiring pattern member of the first winding and folded electrical conductor foil member of the second winding may be easily deformed appropriately to have a form of a coil. The deformation may be easily performed as a result of pressing the single wiring pattern member of the integrated body between a pair of forming members. As a result, either a coil or coils having a number of winding turns either corresponding to a number of times of folding back in the folded pattern or corresponding to a number obtained as a result of multiplying the number of times of folding back by a number of parallelly extending lines of electrical conductor foil extending in each strip part is obtained. Then, a core is inserted into either the coil or coils. Thus, it is possible to provide either an inductor having a large number of winding turns and/or a large inductance, or a transformer having a large winding turn number ratio, without using a conventionally used machine such as a wire winding machine and without requiring a substantial manual labor. Thus, either inductor or transformer manufacturing methods very suitable for mass production can be provided.

Thus, according to the present invention, it is easy to manufacture inductors or transformers which have miniature sizes, light weights, and superior frequency characteristics.

Further, electromagnetic characteristics such as inductances of the inductors or transformers can be easily freely set. Further, the inductors or transformers are very suitable for mass production, and thus it is possible to greatly lower prices thereof.

Further, in a case where the inductors or transformers in the embodiments shown in FIGS. 19 through 27 are integrated with printed circuit boards or the like, as described with reference to FIGS. 13, 14, 15, 16, 17 and 18 for the other embodiments, processes for mounting them onto the printed circuit boards or the like, and processes for connecting lead terminal parts thereof to other circuits in the printed circuit boards or the like can be easily performed. Thus, the present invention provides many advantages.

Further, the present invention is not limited to the above-described embodiments, and variations and modifications may be made without departing from the scope of the present invention.

What is claimed is:

1. An electric coil comprising:

an insulating substrate having a series of alternating reverse directional bends and forming a plurality of strip parts including alternate strip parts and remaining strip parts, each one of said alternate strip parts being respectively arranged adjacent to each one of said remaining strip parts, said plurality of strip parts having respective middle parts bent so that each one of said middle parts of said alternate strip parts is coplanar with one another on a first plane and each one of said middle parts of said remaining strip parts is coplanar with one another on a second plane separated from said first plane by an open portion, wherein said alternate strip parts and remaining strip parts of said substrate each include a plurality of electrical conductors extending in parallel.

2. The electric coil according to claim 1, further comprising a magnetic core at least a portion of which is provided in the open portion.

3. The electric coil as recited in claim 1, further comprising a plurality of forming members having comb teeth, the substrate being provided between the plurality of forming members such that the comb teeth bend the substrate so that each one of said middle parts of said alternate strip parts is coplanar with one another on the first plane and each one of said middle parts of said remaining strip parts is coplaner with one another on the second plane separated from said first plane by the open portion.

4. The electric coil as recited in claim 1, further comprising a plurality of forming members having comb teeth, the substrate being provided between the plurality of forming members such that the comb teeth bend the substrate so that each one of said middle parts of said alternate strip parts is coplanar with one another on the first plane and each one of said middle parts of said remaining strip parts is coplaner with one another on the second plane separated from said first plane by the open portion.

5. An electric coil comprising:

an insulating substrate having a series of alternating reverse directional bends and forming a plurality of strip parts and having a series of alternating reverse directional bends, said plurality of strip parts including alternate strip parts and remaining strip parts, each one of said alternate strip parts being respectively arranged adjacent to each one of said remaining strip parts, said plurality of strip parts having respective middle parts bent so that each one of said middle parts of said alternate strip parts is coplanar with one another on a first plane and each one of said middle parts of said remaining strip parts is coplanar with one another on a second plane separated from said first plane by an open portion, wherein said electrical conductor is formed on said insulating substrate so as to extend through said series of alternating reverse directional bends a plurality of revolutions without coming into electrical contact with itself throughout said plurality of revolutions.

6. The electric coil according to claim 5, further comprising a magnetic core at least a portion of which extends within the open portion.

7. An electric coil manufacturing method comprising the steps of:

processing a single bendable insulating substrate to form a plurality of strip parts having a series of alternating reverse directional bends, said plurality of strip parts including alternate strip parts and remaining strip parts, each one of said alternate strip parts being arranged adjacent to a respective one of said remaining strip parts, said plurality of strip parts having respective middle parts;

extending an electrical conductor along said bendable insulating substrate such that said electrical conductor extends through said series of alternating reverse directional bends a plurality of times without coming into electrical contact with itself;

placing the processed single bendable substrate including the electrical conductor material between first and second forming members; and pressing the first and second forming members together for bending said middle parts of said alternate strip parts so as to cause said middle parts of said alternate strip parts to separate from said middle parts of said remaining strip parts to form an open portion between said alternate strip parts and said remaining strip parts.

8. The electric coil manufacturing method according to claim 7, further comprising a step d) incorporating a magnetic core within said row of strip parts.

* * * * *